US008850635B2

(12) United States Patent
Darrow

(10) Patent No.: US 8,850,635 B2
(45) Date of Patent: Oct. 7, 2014

(54) PATIENT POSITIONING SYSTEM AND RAIL FOR USE THEREIN

(71) Applicant: Joerns Healthcare, LLC, Charlotte, NC (US)

(72) Inventor: Dewey Darrow, South Burlington, VT (US)

(73) Assignee: Joerns Healthcare, LLC, Charlotte, NC (US)

( * ) Notice: Subject to any disclaimer, the term of this patent is extended or adjusted under 35 U.S.C. 154(b) by 0 days.

(21) Appl. No.: 13/914,159

(22) Filed: Jun. 10, 2013

(65) Prior Publication Data

US 2013/0269565 A1 Oct. 17, 2013

Related U.S. Application Data

(62) Division of application No. 12/804,387, filed on Jul. 20, 2010, now Pat. No. 8,458,827.

(60) Provisional application No. 61/343,735, filed on May 3, 2010.

(51) Int. Cl.
*A61G 7/10* (2006.01)
*E01B 25/22* (2006.01)

(52) U.S. Cl.
CPC ..... *E01B 25/22* (2013.01); *A61G 7/1042* (2013.01); *A61G 7/1061* (2013.01); *A61G 7/1044* (2013.01); *A61G 7/1015* (2013.01)
USPC ..... 5/85.1; 5/81.1 R; 104/89; 104/91

(58) Field of Classification Search
USPC ..... 5/81.1 R, 83.1, 85.1, 87.1, 89.1; 104/89, 104/94, 95, 106, 108, 111
See application file for complete search history.

(56) References Cited

U.S. PATENT DOCUMENTS

| | | | | |
|---|---|---|---|---|
| 3,043,408 | A * | 7/1962 | Attwood | 52/842 |
| 3,965,823 | A * | 6/1976 | Bardot | 104/91 |
| 4,694,531 | A * | 9/1987 | Foy | 16/87.4 R |
| 4,768,442 | A * | 9/1988 | Miller | 104/106 |
| 5,598,784 | A * | 2/1997 | Kubsik et al. | 104/111 |
| 7,997,207 | B2 * | 8/2011 | Hess | 104/95 |
| 8,099,806 | B2 * | 1/2012 | Chepurny et al. | 5/81.1 R |
| 8,146,507 | B2 * | 4/2012 | Hess | 104/93 |
| 2005/0098059 | A1 * | 5/2005 | Wallner | 104/89 |

(Continued)

*Primary Examiner* — Robert G Santos
*Assistant Examiner* — Richard G Davis
(74) *Attorney, Agent, or Firm* — MacMillan, Sobanski & Todd, LLC

(57) ABSTRACT

A patient positioning system and a rail for use in the system. According to one embodiment, the system includes first and second stationary rails arranged parallel to one another. First and second sets of mounting assemblies are used to fix the first and second stationary rails, respectively, to a ceiling. A traverse rail is slidably coupled to the stationary rails. The system also includes a harness for holding a patient and a motorized assembly for raising and lowering the harness, the harness being slidably coupled to the traverse rail. At least one of the first stationary rail, the second stationary rail, and the traverse rail is shaped to include a top wall, a bottom wall, a left wall, a right wall, a substantially open front, a substantially open rear, a first rib extending from the left side wall to the right side wall, and a second rib extending from the top wall to the first rib, the first rib and the second rib jointly dividing the interior of the rail into a pair of upper chambers and a lower chamber.

19 Claims, 34 Drawing Sheets

(56) References Cited

U.S. PATENT DOCUMENTS

2006/0156944 A1* 7/2006 Vetesnik ..... 104/89
2008/0271242 A1* 11/2008 Hjort ..... 5/85.1
2009/0077737 A1* 3/2009 Dyhr et al. ..... 5/85.1
2011/0000015 A1* 1/2011 Faucher et al. ..... 5/83.1

* cited by examiner

PATIENT POSITIONING SYSTEM AND RAIL FOR USE THEREIN

CROSS-REFERENCE TO RELATED APPLICATIONS

The present application is a divisional of U.S. patent application Ser. No. 12/804,387, inventor Dewey Darrow, filed Jul. 20, 2010, which, in turn, claims the benefit under 35 U.S.C. 119(e) of U.S. Provisional Patent Application Ser. No. 61/343,735, filed May 3, 2010, the disclosures of both of which are incorporated herein by reference.

BACKGROUND OF THE INVENTION

The present invention relates generally to patient positioning systems and relates more particularly to a novel patient positioning system and to a novel rail for use in said patient positioning system.

It is often difficult for sick and/or disabled persons to move from one position to another position inside a room or between rooms. One approach to this problem has been to provide a patient positioning system that may be used to reposition the patient as needed. Such patient positioning systems often include (i) an overhead rail system that is mounted to the ceiling and (ii) a hoist system that is slidably mounted in the rail system, the hoist system typically including a harness in which the patient may be supported and a motorized mechanism for raising and lowering the harness so that the patient may be lifted and lowered, respectively, as needed. The hoist system may be manually slid from one location within the rail system to another location within the rail system; alternatively, the patient positioning system may additionally include motorized means for moving the hoist system from one location within the rail system to another location within the rail system.

One example of a patient positioning system is disclosed in U.S. Pat. No. 3,780,663, inventor Pettit, issued Dec. 25, 1973, which patent is incorporated herein by reference. In this patent, there is disclosed an ambulatory system for use by debilitated ambulatory patients and the like. The system consists of a track network including a primary track, which extends the length of communicating corridors, and a plurality of secondary tracks, each extending from a point in close proximity with the primary track, and terminating at a point remote therefrom, and a traveling truck, supported by the track network, having a harness depending therefrom for substantially supporting the weight of a human body in suspension for assisting the patients in walking along the corridors as well as to enter and depart from various areas through which the secondary tracks are extended.

Another example of a patient positioning system is disclosed in U.S. Pat. No. 5,511,256, inventor Capaldi, issued Apr. 30, 1996, which patent is incorporated herein by reference. In this patent, there is disclosed a patient lift system that incorporates a transverse bar which carriers a patient lift system for movement between two laterally extending bars. The transverse bar is mounted at the same vertical height as the laterally extending bars and carriers a motor for lifting and lowering the patient. The transverse bar is at the same vertical height as the laterally extending bars. The system also includes a frame that includes an improved corner bracket and also includes vertical adjustment for the legs to achieve leveling of the overall frame. In another feature, a patient lift bar includes four lift points, with two forward lift points spaced by a greater distance than the two rearward lift points to provide greater support to the rear of the patient while the additional distance in the front facilitates entry and removal of the patient lift system.

Other documents relating to patient positioning systems include the following, all of which are incorporated herein by reference: U.S. Pat. No. 7,634,825, inventors Chepurny et al., issued Dec. 22, 2009; U.S. Pat. No. 7,534,066, inventors Lolk et al., issued May 19, 2009; U.S. Pat. No. 7,350,247, inventor Bøgh-Sørensen, issued Apr. 1, 2008; U.S. Pat. No. 7,240,621, inventors Chepurny et al., issued Jul. 10, 2007; U.S. Pat. No. 7,021,427, inventors Skovgaard et al., issued Apr. 4, 2006; U.S. Patent Application Publication No. US 2010/0051889, inventors Chepurny et al., published Mar. 4, 2010; U.S. Patent Application Publication No. US 2010/0043140, inventor Chepurny, published Feb. 25, 2010; and U.S. Patent Application Publication No. US 2009/0199335, inventor Guldmann, published Aug. 13, 2009.

SUMMARY OF THE INVENTION

It is an object of the present invention to provide a novel patient positioning system.

Therefore, according to one aspect of the invention, there is provided a patient positioning system for use in moving a patient from one location to another location, said patient positioning system comprising: (a) a rail system, the rail system being positioned within at least one room of a building and being coupled to a building structure; and (b) a hoist system, the hoist system being coupled to the rail system, the hoist system comprising a harness adapted to hold a patient and means for reversibly moving the harness vertically; (c) wherein the rail system includes a first rail, said first rail being shaped to include a top wall, a bottom wall, a left wall, a right wall, a substantially open front, a substantially open rear, a first rib extending horizontally from the left side wall to the right side wall, and a second rib extending vertically from the top wall to the first rib, the first rib and the second rib jointly dividing the interior of the first rail into a pair of upper chambers and a lower chamber.

According to another aspect of the invention, there is provided a patient positioning system for use in moving a patient from one location to another location, said patient positioning system comprising: (a) first and second stationary rails, said first and second stationary rails being substantially parallel to one another, each of said first and second stationary rails being shaped to include a top wall, a bottom wall, a first side wall, a second side wall, an open front, an open rear, a first flange extending laterally outwardly from said first side wall at a point intermediate to said top wall and said bottom wall, and a second flange extending laterally outwardly from said second side wall at a point intermediate to said top wall and said bottom wall, each of said first and second stationary rails being fixed to a building infrastructure and being recessed within a ceiling such that said first and second flanges are positioned directly under the ceiling; (b) a traverse rail, the traverse rail being slidably mounted on each of said first and second stationary rails; and (c) a hoist system slidably mounted on the traverse rail, the hoist system comprising a harness adapted to hold a patient and means for reversibly moving the harness vertically.

According to yet another aspect of the invention, there is provided a patient positioning system for use in moving a patient from one location to another location, said patient positioning system comprising: (a) first and second stationary rails, said first and second stationary rails being arranged substantially parallel to one another; (b) first fixed mounting means for fixing said first stationary rail to a building structure; (c) second fixed mounting means for fixing said second stationary rail to a building structure; (d) a traverse rail; (e) first slidable coupling means for slidably coupling said traverse rail to each of said first stationary rail and said second stationary rail; (f) a hoist system, the hoist system comprising a harness adapted to hold a patient and means for reversibly moving the harness vertically; and (g) second slidable coupling means for slidably coupling said hoist system to said traverse rail; (h) wherein at least one of said first stationary rail, said second stationary rail, and said traverse rail is shaped to include a top wall, a bottom wall, a left wall, a right wall, a substantially open front, a substantially open rear, a first rib extending horizontally from the left side wall to the right side wall, and a second rib extending vertically from the top wall to the first rib, the first rib and the second rib jointly dividing the interior of the rail into a pair of upper chambers and a lower chamber.

It is also an object of the present invention to provide a novel rail for use in a patient positioning system.

Therefore, according to one aspect of the invention, there is provided a rail for use in a patient positioning system, said rail being a one-piece structure shaped to include a top wall, a bottom wall, a left wall, a right wall, a substantially open front, a substantially open rear, a first rib extending horizontally from said left wall to said right wall, and a second rib extending vertically from said top wall to said first rib, the first rib and the second rib jointly dividing the interior of the rail into a pair of upper chambers and a lower chamber, the top wall being shaped to include a channel extending longitudinally from said substantially open front to said substantially open rear, the lower chamber being shaped to include a pair of channels extending longitudinally from said substantially open front to said substantially open rear for receiving a pair of electrode assemblies, the bottom wall being shaped to include a slit extending from said substantially open front to said substantially open rear and permitting access to said lower chamber through the bottom wall.

According to another aspect of the invention, a rail as described above further includes a first flange and a second flange, said first flange extending laterally from said left wall and extending longitudinally from said substantially open front to said substantially open rear, said second flange extending laterally from said right wall and extending longitudinally from said substantially open front to said substantially open rear.

According to yet another aspect of the invention, there is provided a rail for use in a patient positioning system, said rail comprising a top wall, a bottom wall, a left wall, a right wall, a substantially open front, a substantially open rear, a first rib extending horizontally from said left wall to said right wall, and a second rib extending vertically from said top wall to said first rib, the first rib and the second rib jointly dividing the interior of the rail into a pair of upper chambers and a lower chamber.

According to still another aspect of the invention, there is provided a rail for use in a patient positioning system, said rail being a one-piece structure shaped to include a top wall, a bottom wall, a left wall, a right wall, a substantially open front, a substantially open rear, a first flange, a second flange, a first rib, and a second rib, the first flange extending laterally from said left wall and extending longitudinally from said substantially open front to said substantially open rear, the second flange extending laterally from said right wall and extending longitudinally from said substantially open front to said substantially open rear, the first rib extending horizontally from said left wall to said right wall, the second rib extending vertically from said top wall to said first rib, the first rib and the second rib jointly dividing the interior of the rail into a pair of upper chambers and a lower chamber, the top wall being shaped to include a channel extending longitudinally from said substantially open front to said substantially open rear, the lower chamber being shaped to include a pair of channels extending longitudinally from said substantially open front to said substantially open rear for receiving a pair of electrode assemblies, the bottom wall being shaped to include a slit extending from said substantially open front to said substantially open rear and permitting access to said lower chamber through the bottom wall.

It is also an object of the present invention to provide a novel kit for a patient positioning system.

Therefore, according to one aspect, there is provided a kit for a patient positioning system, said kit comprising: (a) a rail system, the rail system comprising at least a first rail, said first rail being shaped to include a top wall, a bottom wall, a left wall, a right wall, a substantially open front, a substantially open rear, a first rib extending horizontally from the left side wall to the right side wall, and a second rib extending vertically from the top wall to the first rib, the first rib and the second rib jointly dividing the interior of the first rail into a pair of upper chambers and a lower chamber; (b) at least one rail mounting assembly for mounting the rail system on a building structure; (c) a hoist system, the hoist system comprising a harness adapted to hold a patient and means for moving the harness vertically; and (d) a coupling assembly for coupling the hoist system to the rail system.

For purposes of the present specification and claims, various relational terms like "top," "bottom," "proximal," "distal," "upper," "lower," "front," and "rear" are used to describe the present invention when said invention is positioned in or viewed from a given orientation. It is to be understood that, by altering the orientation of the invention, certain relational terms may need to be adjusted accordingly.

Additional objects, as well as features and advantages, of the present invention will be set forth in part in the description which follows, and in part will be obvious from the description or may be learned by practice of the invention. In the description, reference is made to the accompanying drawings which form a part thereof and in which is shown by way of illustration various embodiments for practicing the invention. The embodiments will be described in sufficient detail to enable those skilled in the art to practice the invention, and it is to be understood that other embodiments may be utilized and that structural changes may be made without departing from the scope of the invention. The following detailed description is, therefore, not to be taken in a limiting sense.

BRIEF DESCRIPTION OF THE DRAWINGS

The accompanying drawings, which are hereby incorporated into and constitute a part of this specification, illustrate various embodiments of the invention and, together with the description, serve to explain the principles of the invention. In the drawings wherein like reference numerals represent like parts.

DETAILED DESCRIPTION OF PREFERRED EMBODIMENTS

Figure 1:
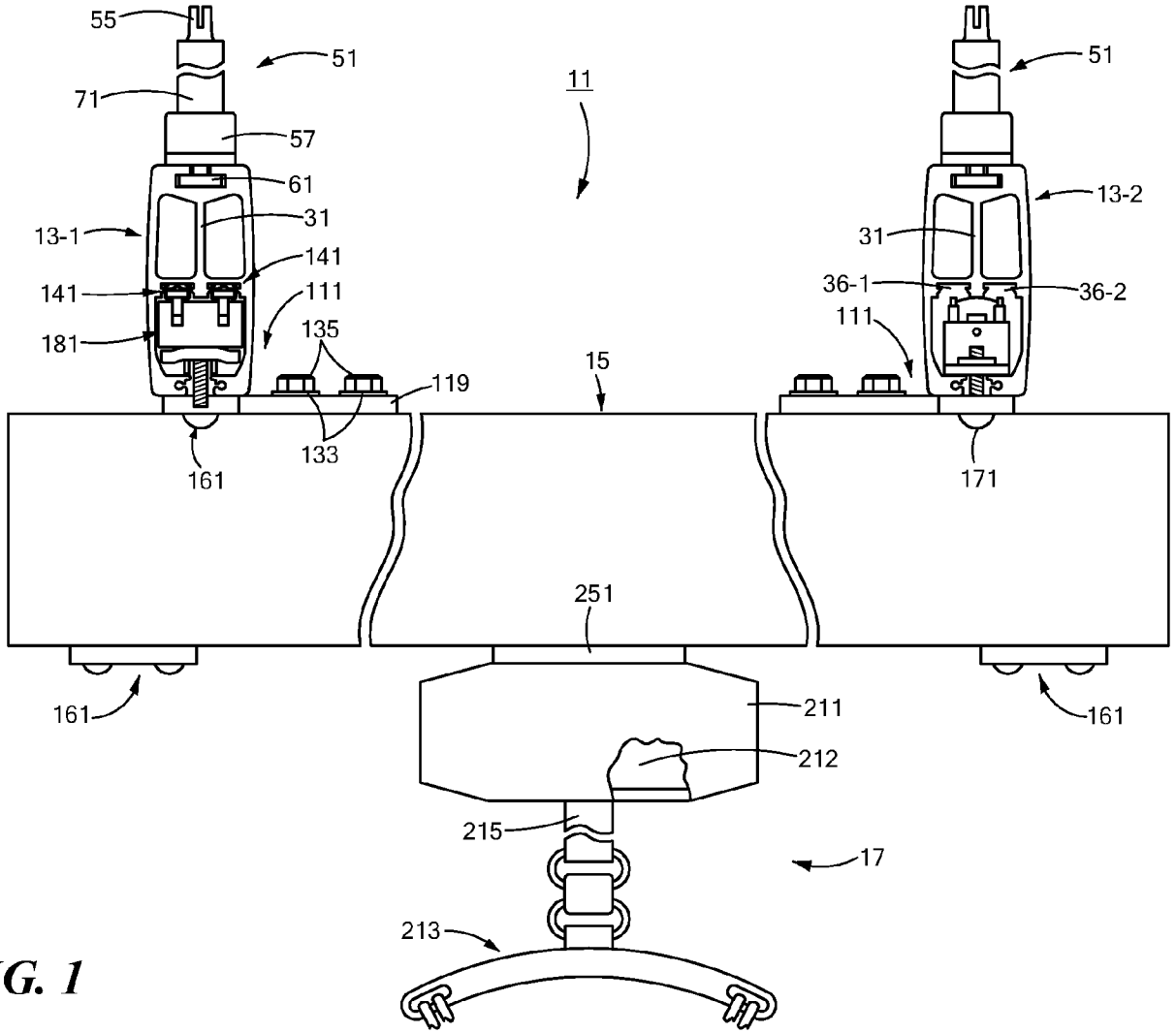
FIG. 1 is a front view, broken away in part, of a first embodiment of a patient positioning system constructed according to the teachings of the present invention, certain components of the patient positioning system not being shown for the sake of clarity.

Referring now to FIG. 1, there is shown a front view of a first embodiment of a patient positioning system constructed according to the teachings of the present invention, said patient positioning system being represented generally by reference numeral 11. For the sake of clarity, certain components of system 11 are not shown in FIG. 1 but are shown and/or described elsewhere.

System 11 may include a pair of stationary rails 13-1 and 13-2, a traverse rail 15, and a hoist system 17.

Figure 2A:
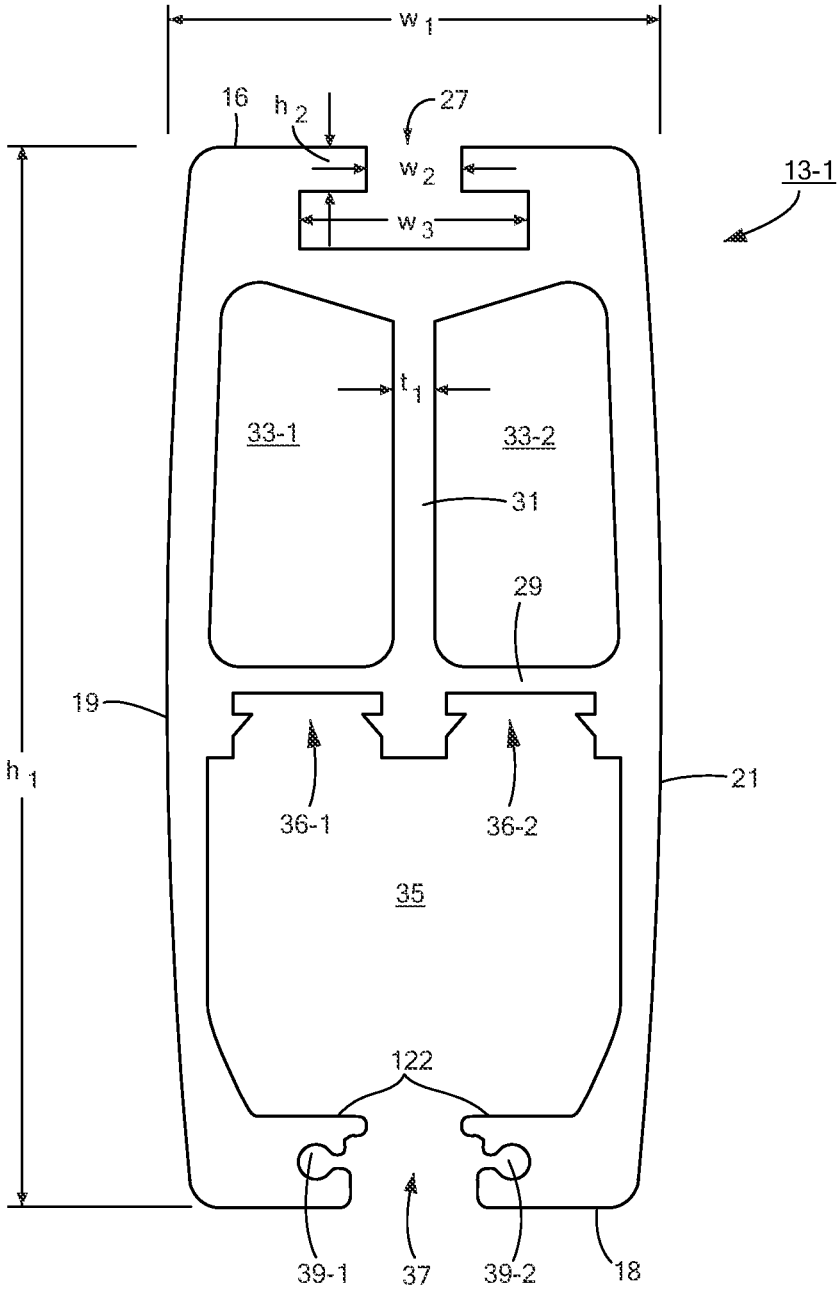
FIGS. 2(*a*) through 2(*c*) are end, side and top views, respectively, of one of the stationary rails shown in FIG. 1.
Figure 2B:
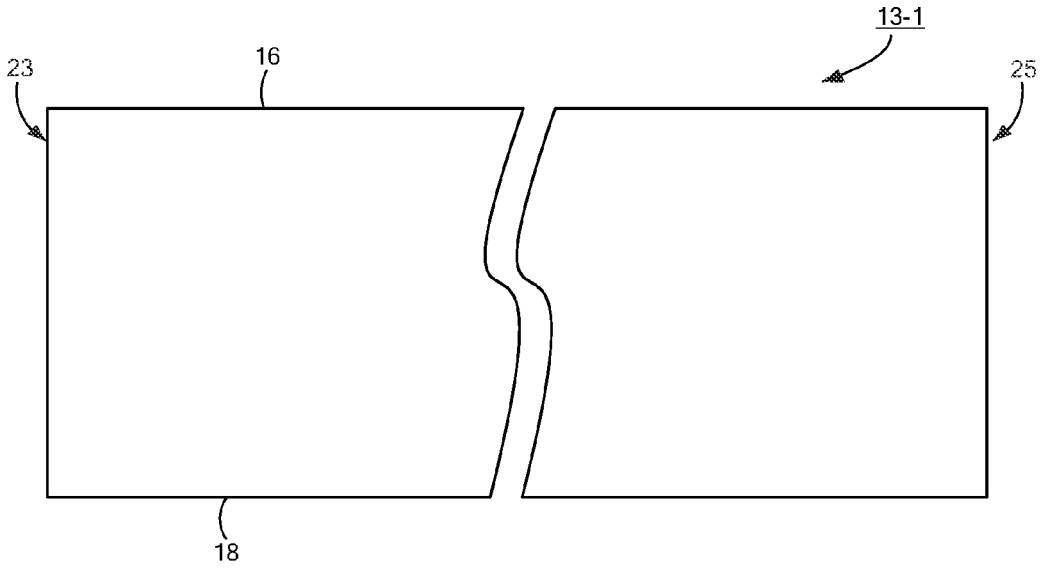
Figure 2C:
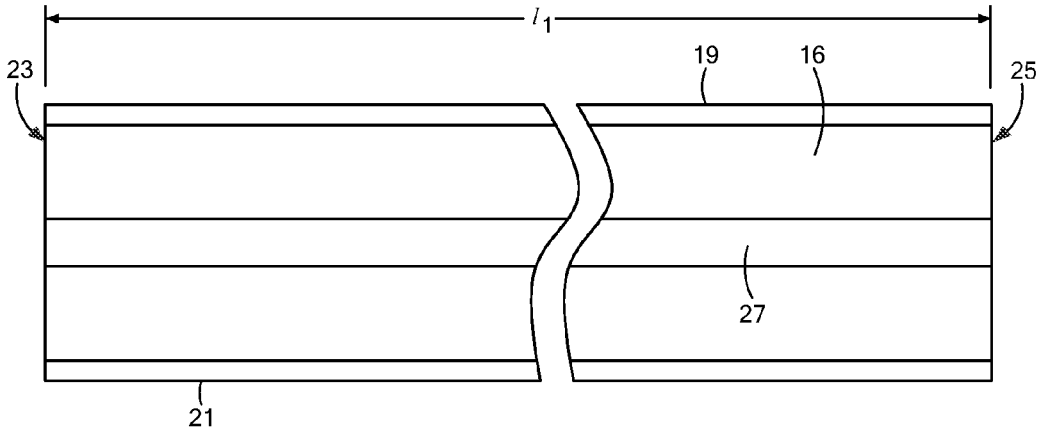

Stationary rails 13-1 and 13-2, which are substantially identical to one another in size, shape and construction, may be made of a suitably strong material, such as an extruded aluminum. Referring now to FIGS. 2(*a*) through 2(*c*), there are shown various views of rail 13-1. As can be seen, rail 13-1 may be a one-piece, substantially hollow structure shaped to include a top wall 16, a bottom wall 18, a left wall 19, a right wall 21, a substantially open front 23, and a substantially open rear 25. A channel 27, which may have an inverted "T"-shape in transverse cross-section, may be formed in top wall 16, channel 27 extending longitudinally from front 23 to rear 25. As will be explained further below, channel 27 may be used to receive hardware for mounting rail 13-1 to a ceiling or other building structure. A rib 29, which may extend horizontally from left side wall 19 to right side wall 21, and a rib 31, which may extend vertically from top wall 16 to rib 29, may jointly divide the interior of rail 13-1 into a pair of upper chambers 33-1 and 33-2 and a lower chamber 35, each of chambers 33-1, 33-2 and 35 extending longitudinally from front 23 to rear 25. Chambers 33-1 and 33-2 may be generally rectangular in transverse cross-section, each with a height extending vertically in the directions of top wall 16 and bottom wall 18 that exceeds a width extending horizontally in the directions of side walls 19 and 21. Chambers 33-1 and 33-2 may be mirror images of one another, with the heights of chambers 33-1 and 33-2 being least in the area proximate to rib 31 and being greatest in the area proximate to side walls 19 and 21, respectively. Chambers 33-1 and 33-2 may function primarily to reduce the weight of rail 13-1, with ribs 29 and 31 providing structural strength to rail 13-1 against deformation due to weight that may be hung from rail 13-1. As will be discussed further below, lower chamber 35 may be used to receive a trolley capable of longitudinal movement backwards and forwards therewithin. In addition, lower chamber 35 may be shaped to include a pair of channels 36-1 and 36-2 extending longitudinally from front 23 to rear 25. As will be discussed further below, each of channels 36-1 and 36-2 may be used to receive an electrode assembly. A slit 37 may completely bisect bottom wall 18, slit 37 extending longitudinally from front 23 to rear 25 and providing access to chamber 35 from below. Slit 37 may be shaped to include a pair of grooves 39-1 and 39-2 in bottom wall 18, grooves 39-1 and 39-2 terminating in a substantially circular shape in transverse cross-section. Grooves 39-1 and 39-2 may be used to receive pins (not shown) so that a plurality of rails 13-1 may be joined in an end-to-end fashion while maintaining alignment relative to one another.

Some exemplary dimensions for rail 13-1 may be as follows: a length $l_1$ from front 23 to rear 25 of approximately 20 feet; a height $h_1$ from the top surface of wall 16 to the bottom surface of wall 18 of approximately 4.300 inch; an outermost width $w_1$ from the outer surfaces of walls 19 and 21 of approximately 2.010 inch; a thickness $t_1$ of rib 31 of approximately 0.135 inch; an upper width $w_2$ of channel 27 of approximately 0.464 inch; a lower width $w_3$ of channel 27 of approximately 1.000 inch; and an upper height $h_2$ of channel 27 of approximately 0.185. Rail 13-1 may have a weight of approximately 3.242 lbs/ft (or approximately 4.824 kg/m).

It should be understood that, although rails 13-1 and 13-2 have a straight profile (as viewed from above as in FIG. 2(*c*)), rails 13-1 and 13-2 need not have such a profile and may alternatively have other profiles, such as, a curved profile.

Figure 3:
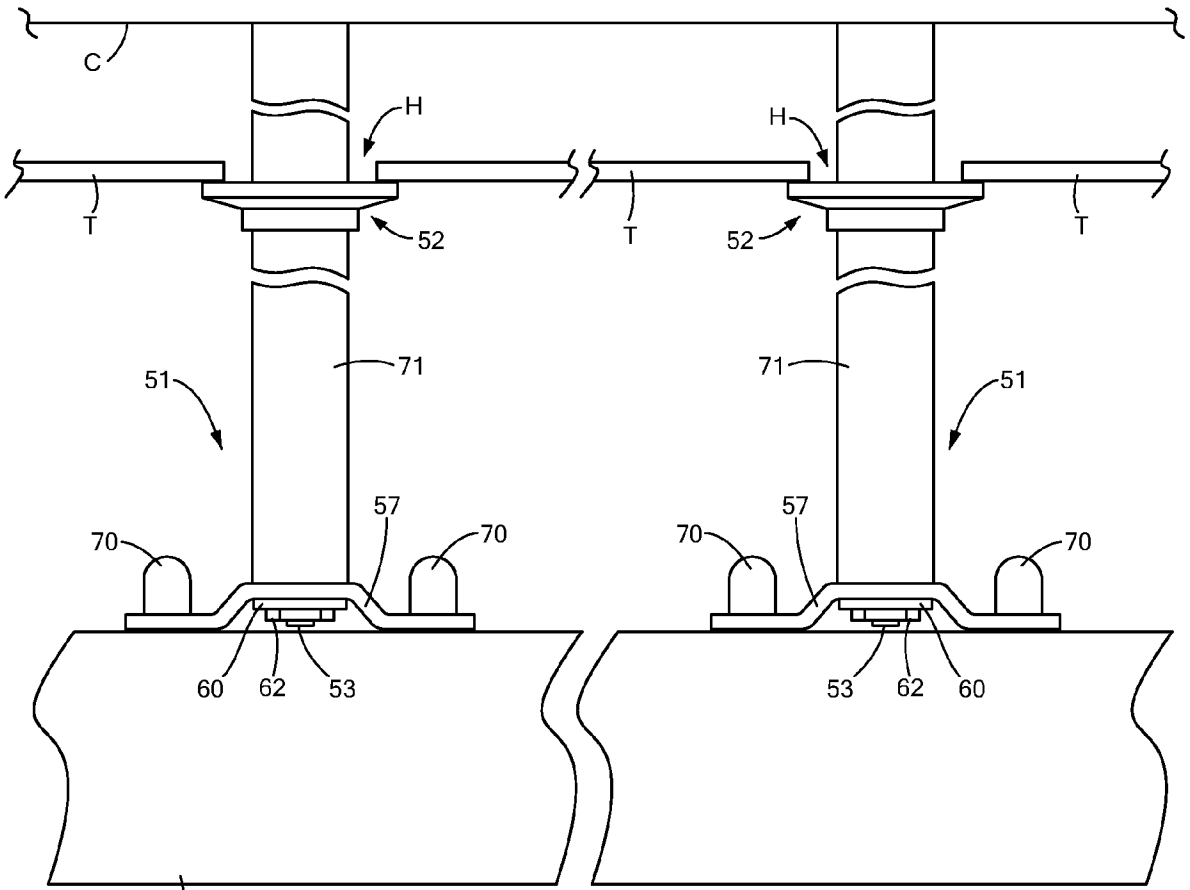
FIG. 3 is an enlarged fragmentary side view of the patient positioning system of FIG. 1, showing one of the stationary rails mounted to a ceiling using a plurality of mounting assemblies.

Referring back now to FIG. 1, rails 13-1 and 13-2 may be oriented substantially parallel to one another, and system 11 may further comprise means for fixedly mounting rails 13-1 and 13-2 to a ceiling structure (such as a beam, a concrete slab, or the like) while maintaining said parallel orientation of rails 13-1 and 13-2. As seen best in FIG. 3, said mounting means may comprise a plurality of substantially identical mounting assemblies 51 securing a common rail (rail 13-1 being shown in FIG. 3) to a ceiling C, with adjacent mounting assemblies 51 being spaced apart from one another on the rail by a suitable distance to hold the combined weight of rails 13-1 and 13-2, transverse rail 15, hoist system 17, and a patient. The present inventor has found a spacing between adjacent assemblies 51 of approximately 3.5-4.0 meters to be suitable for this purpose, with a spacing of 3.5 meters being preferred. As shown in FIG. 3, where, for example, ceiling tiles T are positioned between the ceiling C and rail 13-1 and where holes H are provided in the ceiling tiles T to permit the mounting means to pass through the ceiling tiles T, system 11 may further comprise annular members or rosettes 52 which may be used to cover the unoccupied portions of holes H for aesthetic reasons.

Figure 4:
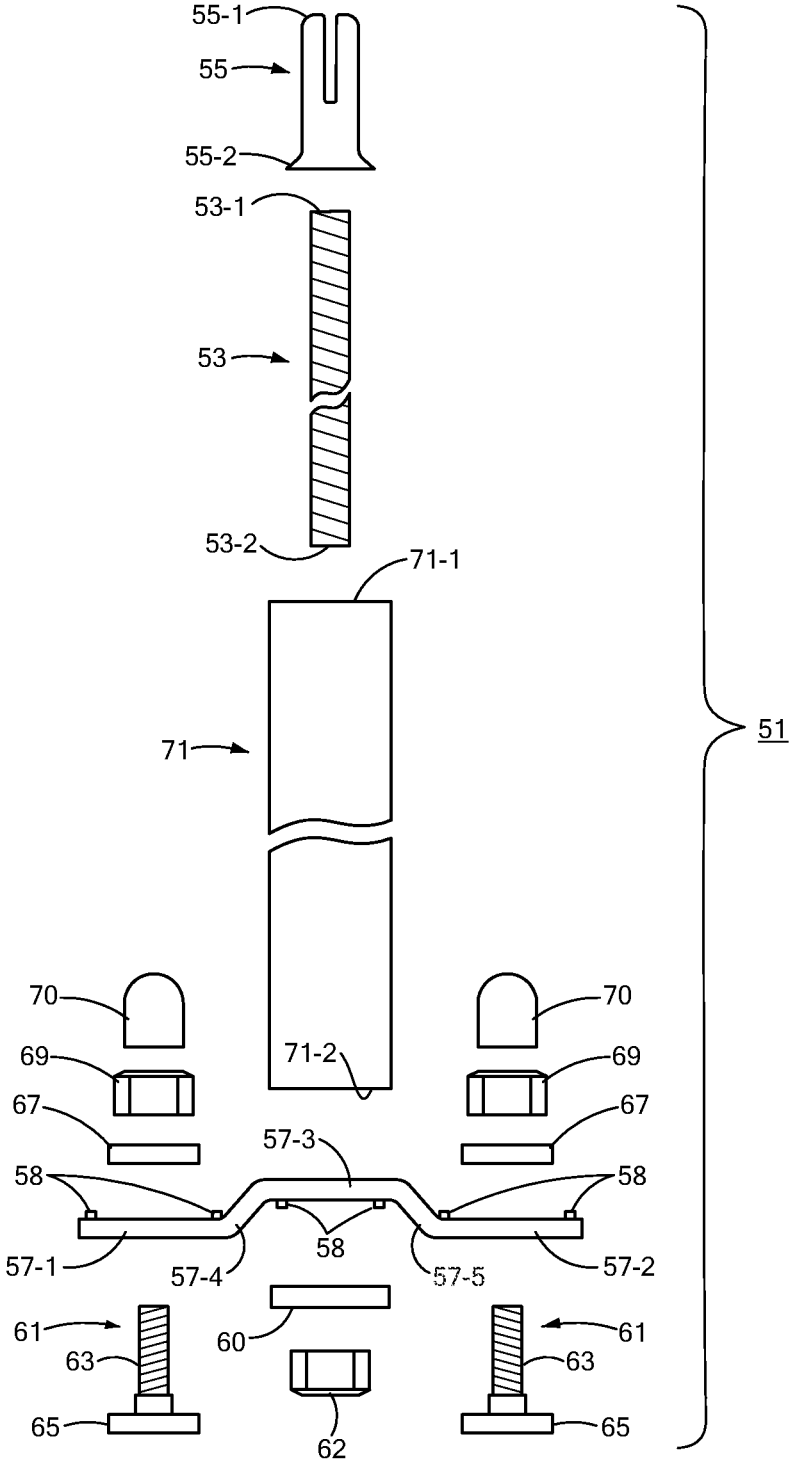
FIG. 4 is an exploded view of one of the mounting assemblies shown in FIG. 3.

Referring now to FIG. 4, there is shown an exploded view of one of the mounting assemblies 51 shown in FIG. 3. As can be seen, said mounting assembly 51 may comprise an elongated threaded rod 53. Threaded rod 53, which may be a one-piece structure made of a suitably strong material, such as steel, may be shaped to include a top end 53-1 and a bottom end 53-2. Threaded rod 53 may be dimensioned to have a diameter of ⅜ inch (or ½ inch) and a length of approximately 3 feet.

Assembly 51 may further include an expandable wall anchor 55. Anchor 55, which may be conventional in construction, may include a slotted top portion 55-1 and an internally threaded bottom portion 55-2. Top portion 55-1 is adapted to be inserted into a suitably dimensioned hole that has been drilled into or otherwise provided in a ceiling structure and, thereafter, may be expanded radially outwardly using a suitable tool, thereby causing anchor 55 to be secured to the ceiling structure. Bottom portion 55-2 is adapted to threadingly receive top end 53-1 of rod 53, thereby enabling rod 53 to be secured to the ceiling structure.

Figure 5:
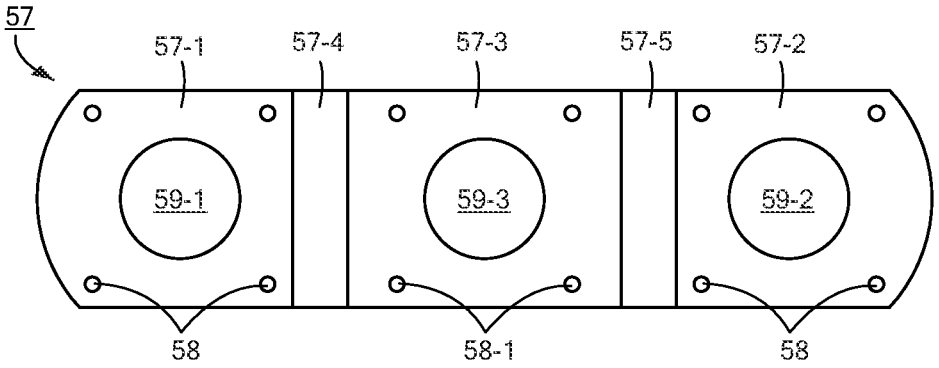
FIG. 5 is an enlarged top view of the bracket of the mounting assembly of FIG. 4.

Assembly 51 may further comprise a bracket 57. Bracket 57, which is also shown separately in FIG. 5, may be a one-piece structure made of a suitably strong material, such as steel. Bracket 57 may be shaped to include a pair of coplanar outer end portions 57-1 and 57-2, a central portion 57-3 that is raised relative to end portions 57-1 and 57-2, a first ramped portion 57-4 connecting outer end portion 57-1 to one end of central portion 57-3, and a second ramped portion 57-5 connecting the opposite end of central portion 57-3 to outer end portion 57-2. End portion 57-1 may be shaped to include a transverse opening 59-1, end portion 57-2 may be shaped to include a transverse opening 59-2, and end portion 57-3 may be shaped to include a transverse opening 59-3. Transverse opening 59-3 may be appropriately dimensioned to receive the bottom end 53-2 of threaded rod 53, which may be secured to bracket 57 with a slotted washer 60 and a nut 62. Projections 58 may be provided on the bottom surface of central portion 57-3 for use in properly positioning washer 60 against bracket 57. Additional projections 58 may be provided on the top surfaces of end portions 57-1 and 57-2 for a similar purpose to become apparent below. (Depressions 58-1, formed in the process of making projections 58, are located on the top surface of central portion 57-3 and on the bottom surfaces of end portions 57-1 and 57-2.)

Figure 6A:
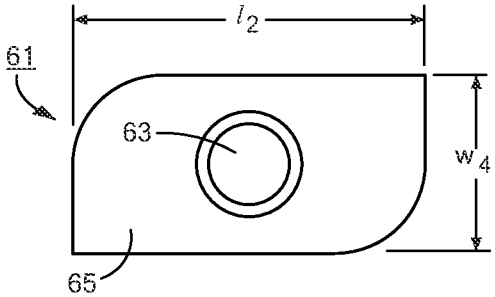
FIGS. 6(*a*) and 6(*b*) are top and bottom views, respectively, of one of the threaded T-bolts shown in FIG. 4.
Figure 6B:
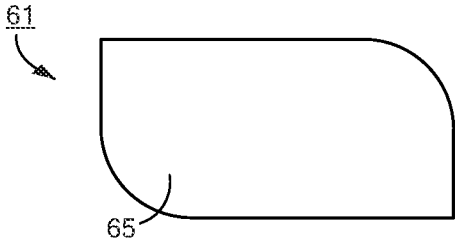

Assembly 51 may further comprise a pair of substantially identical threaded T-bolts 61 (bottom and top views of a representative T-bolt 61 also being shown separately in FIGS. 6(*a*) and 6(*b*), respectively). Each of T-bolts 61 may be a one-piece structure made of a strong material, such as steel, and may comprise a threaded shaft 63 and a generally rectangular head 65. Each shaft 63 may be appropriately dimensioned to be inserted through opening 59-1 or opening 59-2 of bracket 57 and thereafter retained by a slotted washer 67 and a nut 69. A cap 70, which may be made of plastic or rubber, may be mounted over the exposed end of shaft 63, as well as over nut 69 and washer 67. Head 65 may be appropriately dimensioned to have a width $w_4$ that is slightly less than upper width $w_2$ of channel 27 and a length $l_2$ that is approximately equal to the lower width $w_3$ of channel 27. In this manner, head 65 may be loaded downwardly into channel 27 by orienting its length $l_2$ so that it is parallel to the longitudinal axis of channel 27; thereafter, head 65 may be secured within channel 27 by rotating bolt 61 about shaft 63 so that the length $l_2$ of head 65 is oriented parallel to the width $w_3$ of channel 27 and perpendicular to the longitudinal axis of channel 27. To facilitate the rotation of head 65 within channel 27, the corners of head 65 may be rounded as shown.

Assembly 51 may further comprise a tubular post 71, which may be used to provide additional columnar strength to assembly 51. Post 71, which may be made of a strong material, such as extruded aluminum, may be appropriately dimensioned to be inserted around threaded rod 53, with the top end 71-1 of post 71 lying flush against the ceiling structure and the bottom end 71-2 of post 71 lying flush against the top surface of central portion 57-3 of bracket 57.

To fix rail 13-1 to a ceiling using assembly 51, one may drill a suitable hole in the ceiling and then may insert anchor 55 into said hole and then may set anchor 55 in said hole using a suitable tool to expand anchor 55 within said hole. Next, one may screw top end 53-1 of rod 53 into bottom portion 55-2 of anchor 55 until rod 53 is securely anchored to the ceiling. Next, one may insert post 71 up over rod 53 and then may secure bottom end 53-2 of rod 53 to bracket 57 using washer 60 and nut 62 so that the top end 71-1 of post 71 lies flush against the ceiling and the bottom end 71-2 of post 71 lies flush against central portion 57-3 of bracket 57. Next, one may couple a pair of T-bolts 61 to rail 13-1 first by lowering the heads 65 of the T-bolts 61 into channel 27 and then by rotating the shafts 63 of the T-bolts 61 so that their respective heads 65 are oriented perpendicularly to channel 27. Next, one may insert the shafts 63 of the aforementioned two T-bolts 61 through openings 59-1 and 59-2, respectively, of bracket 57 and may secure each of these two T-bolts 61 to bracket 57 using a washer 67 and a nut 69. By doing so, the bottom surfaces of end portions 57-1 and 57-2 of bracket 57 may lie flush against top wall 16 of rail 13-1. A cap 70 may then be mounted over the exposed end of each shaft 63, as well as over its corresponding washer 67 and nut 69. Additional assemblies 51 coupling rail 13-1 to the ceiling may be spaced apart by approximately 3.5-4 meters.

It should be understood that the same type of procedure as described above may be used to fix rail 13-2 to the ceiling.

Figure 7A:
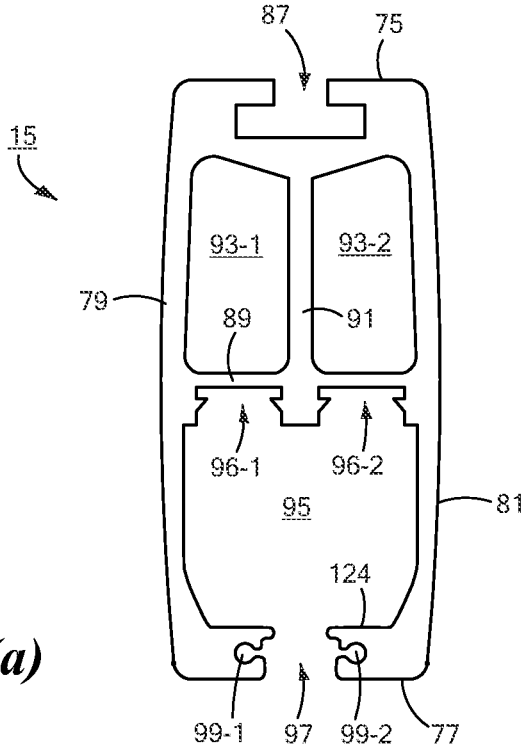
FIGS. 7(*a*) and 7(*b*) are end and top views, respectively, of the traverse rail shown in FIG. 1.
Figure 7B:
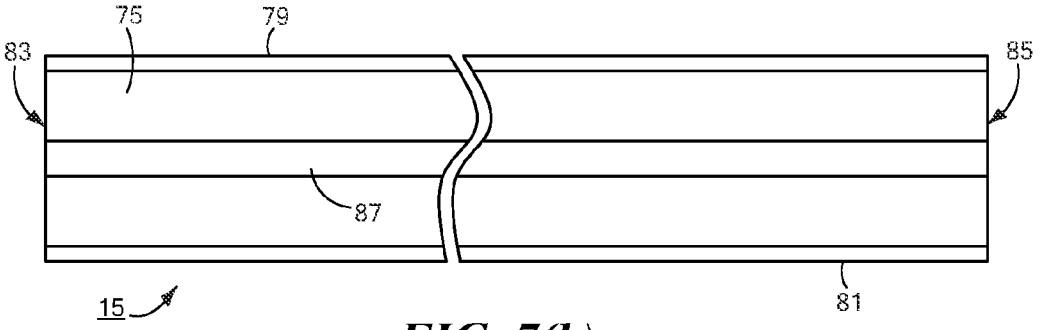

Referring now to FIGS. 7(*a*) and 7(*b*), there are shown end and top views, respectively, of traverse rail 15. As can be seen, traverse rail 15 may be substantially identical in size, shape and construction to stationary rails 13-1 and 13-2 (although traverse rail 15 is typically not as long as stationary rails 13-1 and 13-2). Accordingly, traverse rail 15 may be a one-piece, substantially hollow structure shaped to include a top wall 75, a bottom wall 77, a left wall 79, a right wall 81, a substantially open front 83, and a substantially open rear 85. A channel 87, which may have an inverted "T"-shape in transverse cross-section, may be formed in top wall 75, channel 87 extending longitudinally from front 83 to rear 85. As will be explained further below, channel 87 may be used to receive hardware for mounting traverse rail 15 to rails 13-1 and 13-2. A rib 89, which may extend horizontally from left side wall 79 to right side wall 81, and a rib 91, which may extend vertically from top wall 75 to rib 89, may jointly divide the interior of rail 15 into a pair of upper chambers 93-1 and 93-2 and a lower chamber 95, each of chambers 93-1, 93-2 and 95 extending longitudinally from front 83 to rear 85. Chambers 93-1 and 93-2 may be generally rectangular in transverse cross-section, each with a height extending vertically in the directions of top wall 75 and bottom wall 77 that exceeds a width extending horizontally in the directions of side walls 79 and 81. Chambers 93-1 and 93-2 may be mirror images of one another, with the heights of chambers 93-1 and 93-2 being least in the area proximate to rib 91 and being greatest in the area proximate to side walls 79 and 81, respectively. Chambers 93-1 and 93-2 may function primarily to reduce the weight of rail 15, with ribs 89 and 91 providing structural strength to rail 15 against deformation due to weight that may be hung from rail 15. As will be discussed further below, lower chamber 95 may be used to receive a hoist trolley capable of longitudinal movement backwards and forwards therewithin. In addition, lower chamber 95 may be shaped to include a pair of channels 96-1 and 96-2 extending longitudinally from front 83 to rear 85. As will be discussed further below, each of channels 96-1 and 96-2 may be used to receive an electrode assembly. A slit 97 may completely bisect bottom wall 77, slit 97 extending longitudinally from front 83 to rear 85 and providing access to chamber 95 from below. Slit 97 may be shaped to include a pair of grooves 99-1 and 99-2 in bottom wall 77, grooves 99-1 and 99-2 terminating in a substantially circular shape in transverse cross-section.

Figure 8:
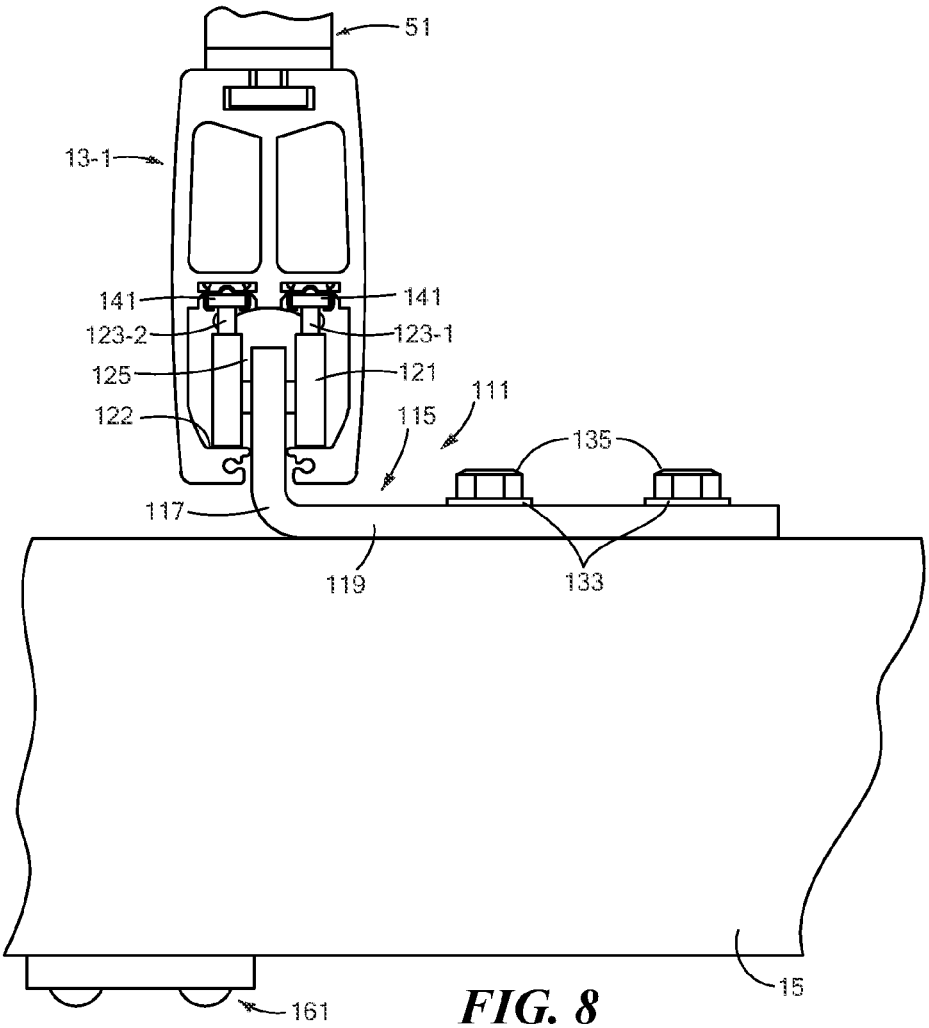
FIG. 8 is an enlarged fragmentary front view of the system of FIG. 1, showing the slidable coupling of the traverse rail to one of the stationary rails, with certain components of the system not being shown for the sake of clarity.
Figure 9:
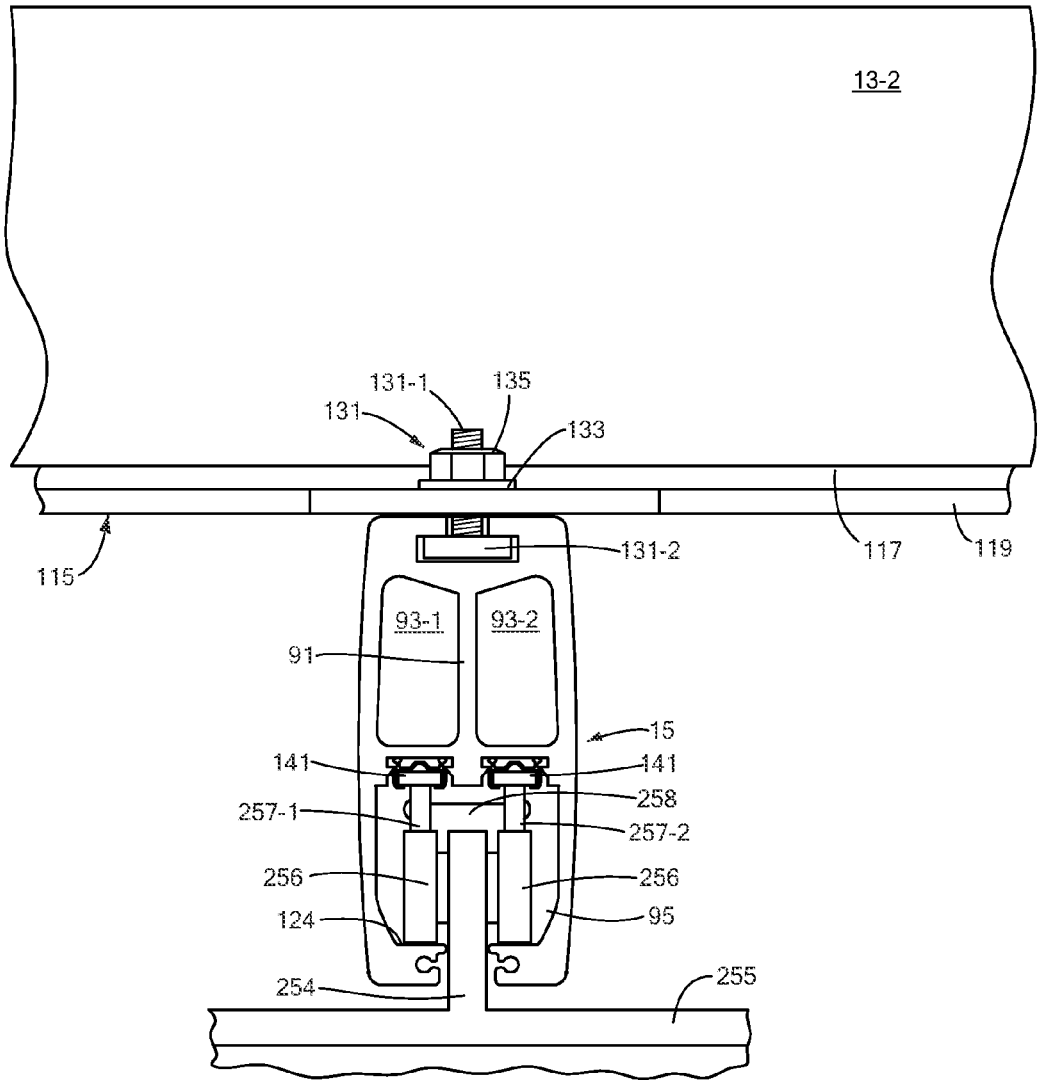
FIG. 9 is an enlarged fragmentary side view of the system of FIG. 1 (with the stationary rail of FIG. 8 and its associated mounting assemblies not being shown), showing the slidable coupling of the traverse rail to the other of the stationary rails, with certain components of the system not being shown for the sake of clarity.
Figure 10:
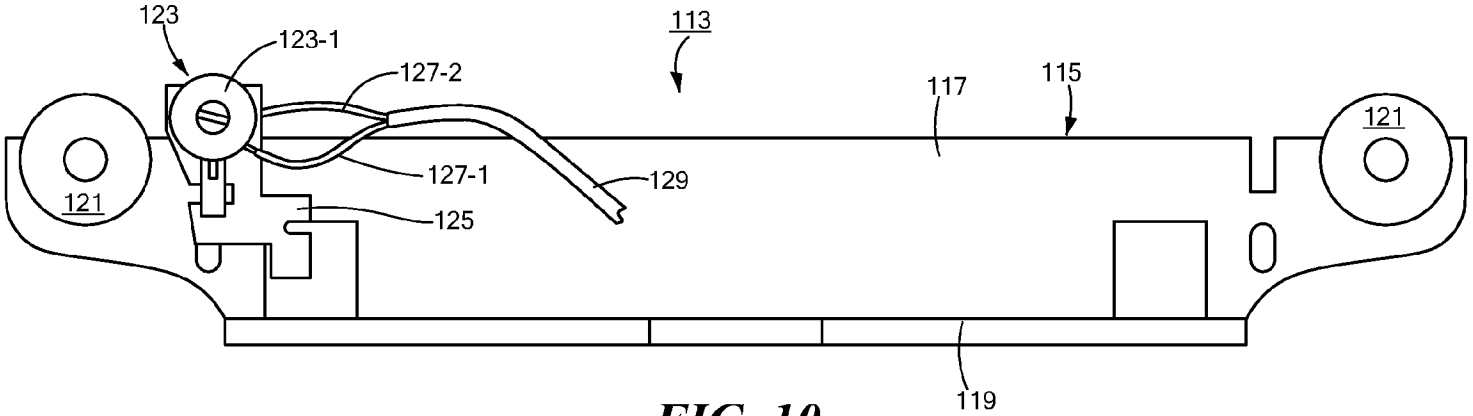
FIG. 10 is an enlarged fragmentary side view of the stationary rail trolley shown in FIG. 1.
Figure 11:
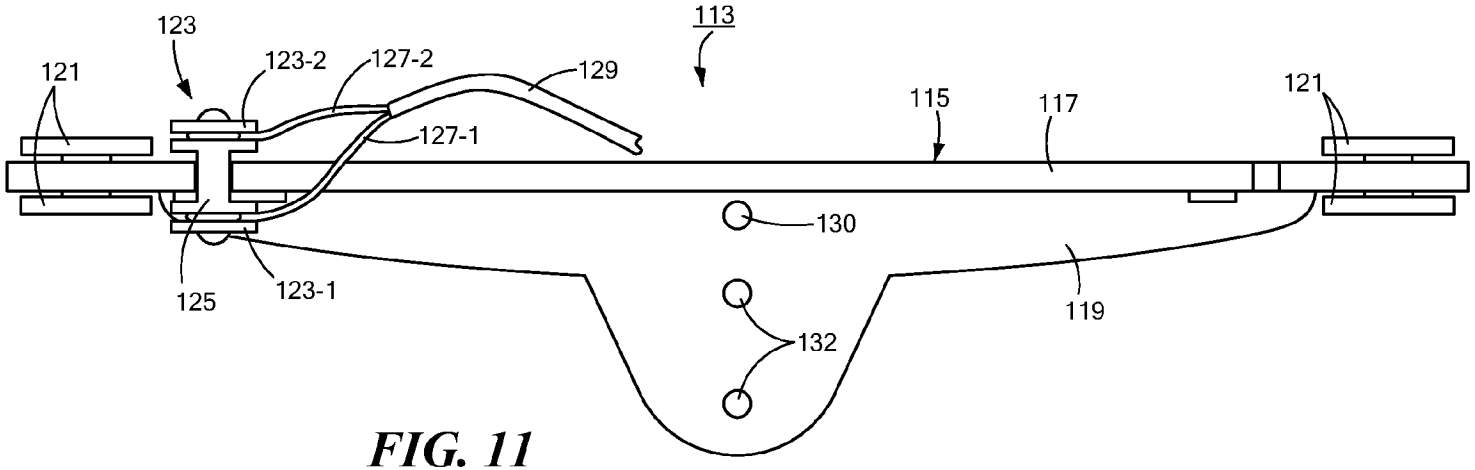
FIG. 11 is an enlarged fragmentary top view of the stationary rail trolley shown in FIG. 1.
Figure 12A:
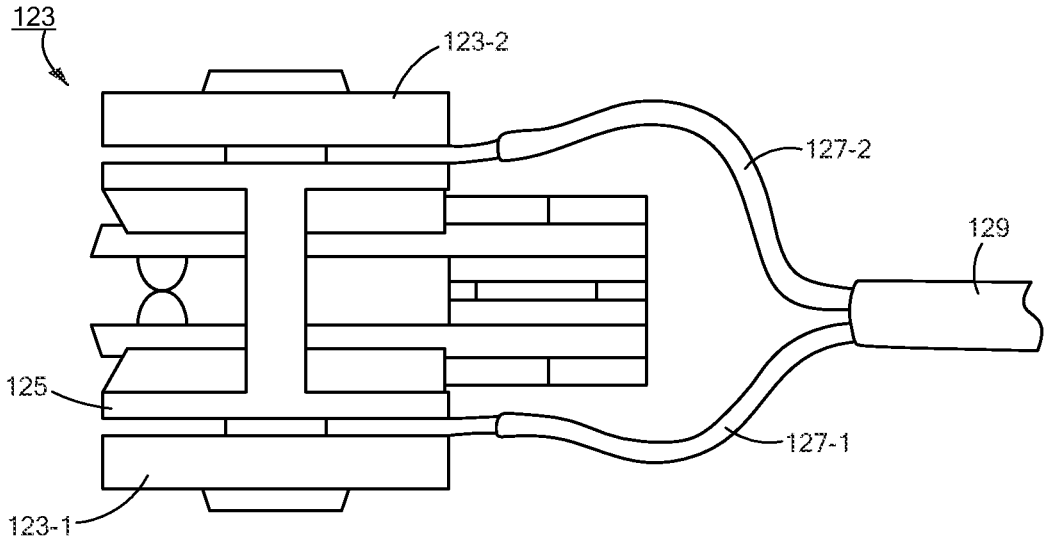
FIGS. 12(*a*) through 12(*c*) are enlarged fragmentary top, enlarged fragmentary side, and enlarged fragmentary front views, respectively, of the charging pickup assembly of the stationary rail trolley shown in FIG. 10.
Figure 12B:
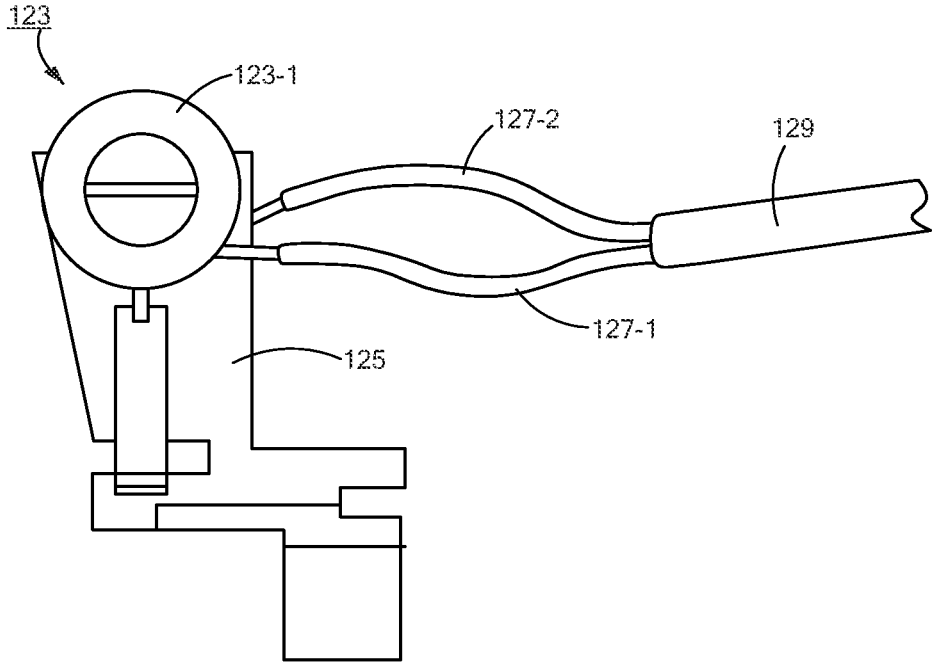
Figure 12C:
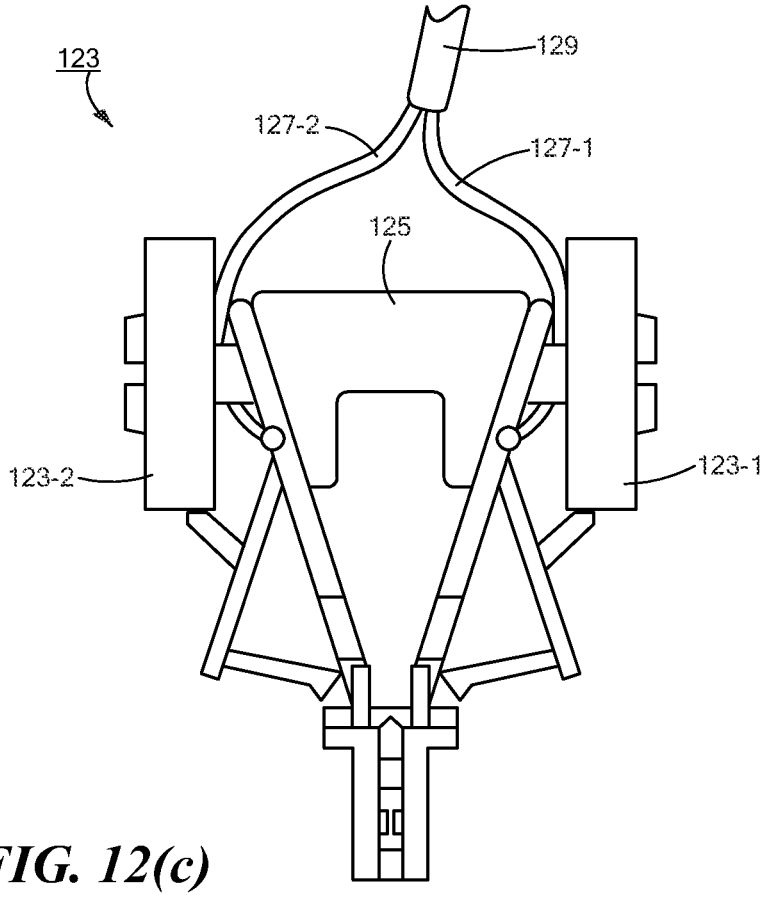

Referring back now to FIG. 1, as well as to FIGS. 8 and 9, system 11 may further comprise means for slidably coupling traverse rail 15 to stationary rails 13-1 and 13-2. Said slidable coupling means may comprise a pair of substantially identical coupling assemblies 111, one of said coupling assemblies 111 being used to slidably couple traverse rail 15 to stationary rail 13-1 and the other of said coupling assemblies 111 being used to slidably couple traverse rail 15 to stationary rail 13-2. Coupling assembly 111 may comprise a stationary rail trolley 113. Trolley 113, which is also shown separately in FIGS. 10 and 11, may comprise a substantially right-angled bracket 115. Bracket 115, which may be a one-piece structure made of a strong material, such as steel, may comprise a substantially vertical portion 117 and a substantially horizontal portion 119. A plurality of wheels 121, which may be made of plastic or another suitable material, may be rotatably mounted on vertical portion 117. Wheels 121 and vertical portion 117 may be appropriately dimensioned so that wheels 121 may ride along the inner bottom surface 122 of chamber 35 of stationary rail 13-1 or 13-2, with vertical portion 117 extending through the corresponding slit 37 of stationary rail 13-1 or 13-2. Trolley 113 may further comprise a charging pickup assembly 123 (also shown separately in FIGS. 12(*a*) through 12(*c*)). Assembly 123, in turn, may comprise a pair of electrically-conductive contact wheels 123-1 and 123-2. Wheels 123-1 and 123-2 may be rotatably mounted on a clip 125 that, in turn, may be slidably mounted in a vertical direction on vertical portion 117, clip 125 being urged upwardly by a spring (not shown). Wheels 123-1 and 123-2 may be electrically coupled to electrical leads 127-1 and 127-2, respectively, the purpose of which will also be discussed below. Leads 127-1 and 127-2 may be bundled in a cable 129 that may be fed down through an opening 130 in horizontal portion 119 so that it may be inserted into chamber 95 of traverse rail 15.

Figure 13A:
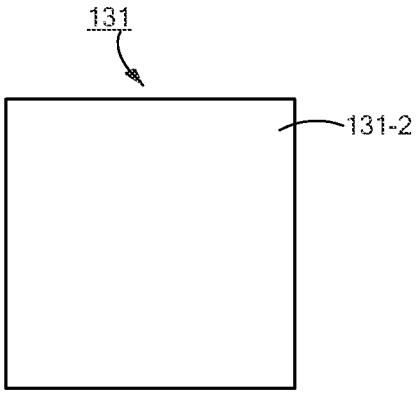
FIGS. 13(*a*) and 13(*b*) are enlarged top and enlarged bottom views, respectively, of the square T-bolt shown in FIG. 9.
Figure 13B:
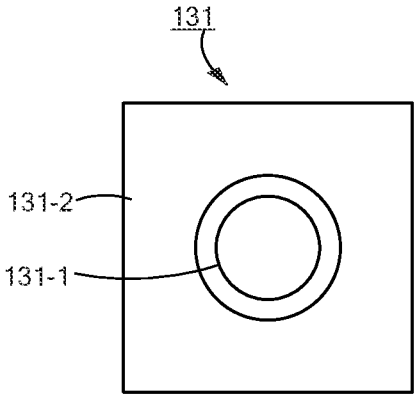

Each of assemblies 111 may further comprise a pair of substantially identical T-bolts 131 (of which one is shown in FIG. 9 and which is also shown separately in FIGS. 13(*a*) and 13(*b*)). T-bolts 131 may be a one-piece structure made of a strong material, such as steel, and may comprise a threaded shaft 131-1 and a generally square head 131-2. Each shaft 131-1 may be appropriately dimensioned to be inserted up through a corresponding opening 132 of horizontal portion 119 of bracket 115 and thereafter retained by a washer 133 and a locking nut 135. Head 131-2 may be appropriately dimensioned to be loaded into channel 87 of traverse rail 15 from one end of channel 87 and, thereafter, not to be withdrawn from channel 87 through the top of channel 87.

Figure 14:
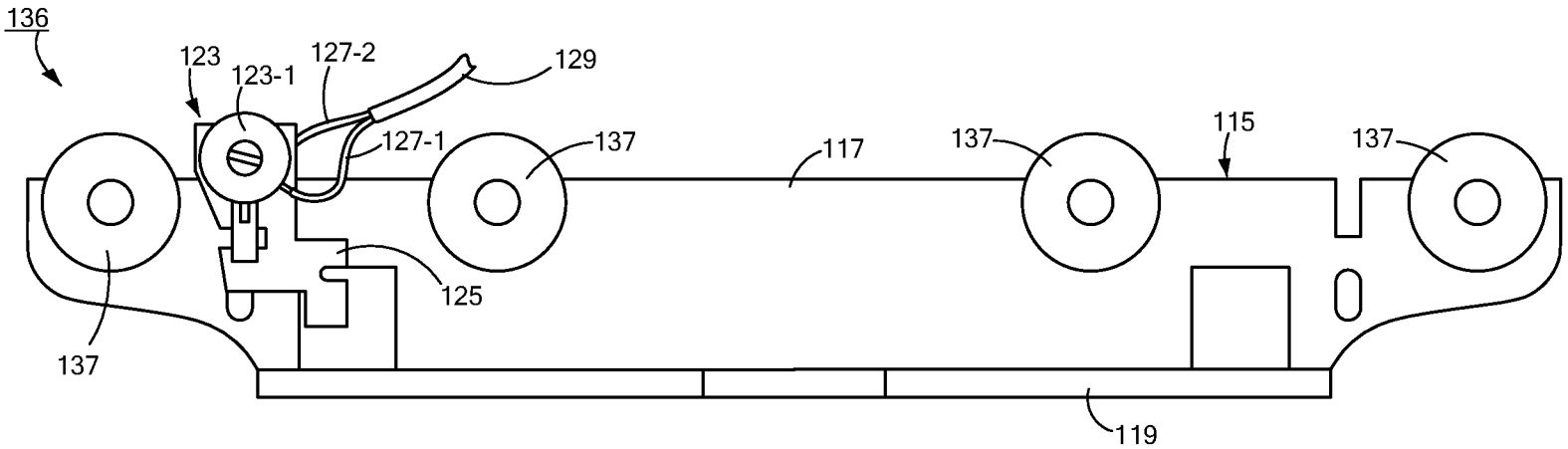
FIG. 14 is a fragmentary side view of a first alternate stationary rail trolley that may be used in place of the stationary rail trolley of FIGS. 10 and 11 in the patient positioning system of FIG. 1.

Referring now to FIG. 14, there is shown a side view of a first alternate stationary rail trolley that may be used in place of stationary rail trolley 113 in patient positioning system 11, said first alternate stationary rail trolley being represented generally by reference numeral 136.

Trolley 136 is similar in most respects to trolley 113, the principal difference between the two trolleys being that, whereas trolley 113 may comprise four wheels 121 (i.e., two pairs of wheels 121), trolley 136 may comprise eight wheels 137 (i.e., four pairs of wheels 137). Trolley 136 may also differ from trolley 113 by having a slightly greater length. One possible advantage of trolley 136 over trolley 113 is that, by virtue of its having two sets of wheels 137 proximate to its front end and two sets of wheels 137 proximate two its rear end, trolley 136 may be better at maintaining rolling contact with inner bottom surface 122 of chamber 35 with at least one of its two front sets of wheels 137 and with at least one of its two rear sets of wheels 137, particularly if a short length of the bottom portion of the rail is removed for some reason.

Figure 15:
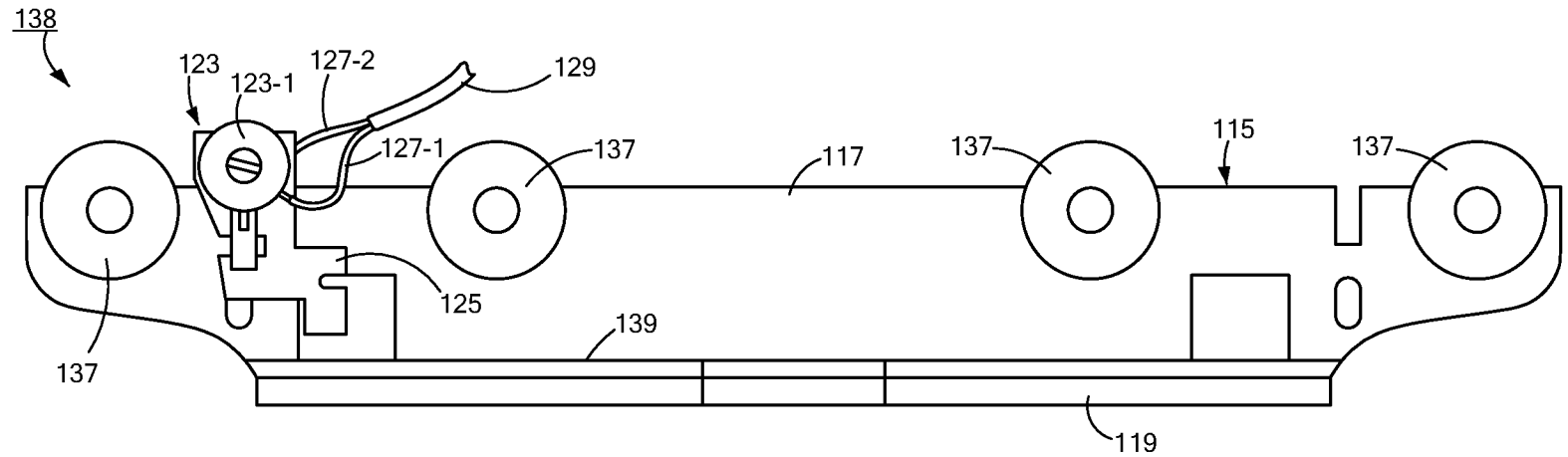
FIG. 15 is a fragmentary side view of a second alternate stationary rail trolley that may be used in place of the stationary rail trolley of FIGS. 10 and 11 in the patient positioning system of FIG. 1.

Referring now to FIG. 15, there is shown a side view of a second alternate stationary rail trolley that may be used in place of stationary rail trolley 113 in patient positioning system 11, said second alternate stationary rail trolley being represented generally by reference numeral 138.

Trolley 138 is similar in most respects to trolley 136, the principal difference between the two trolleys being that trolley 138 may additionally comprise a plate 139. Plate 139, which may be made of a strong material, such as steel, may be similar in footprint to horizontal portion 119 and may be secured thereto, for example, by spot welding. One possible advantage of trolley 138 over trolley 136 is that, by virtue of its having plate 139, trolley 138 may be better than trolley 136 at supporting heavy loads suspended from traverse rail 15.

Figure 16A:
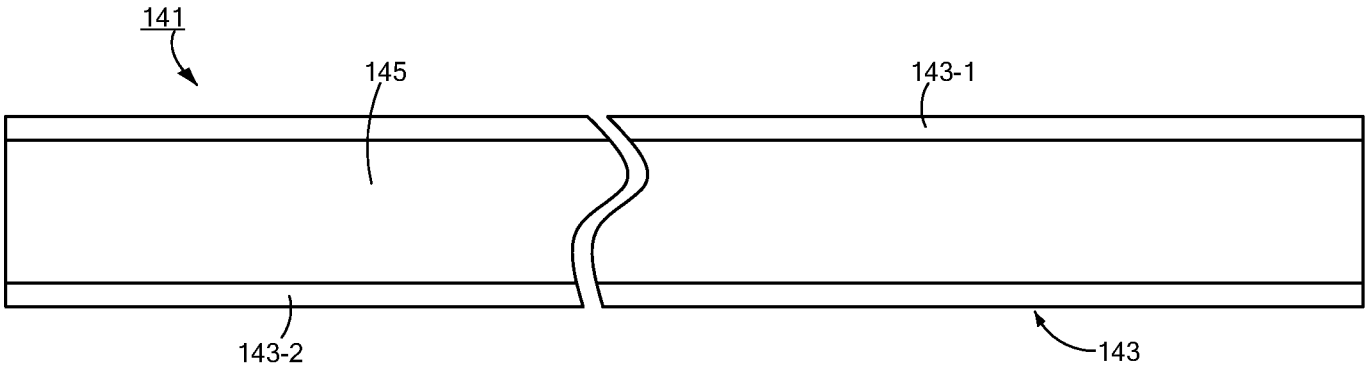
FIGS. 16(*a*) and 16(*b*) are enlarged bottom and enlarged end views, respectively, of one of the electrode assemblies shown in FIG. 1.
Figure 16B:
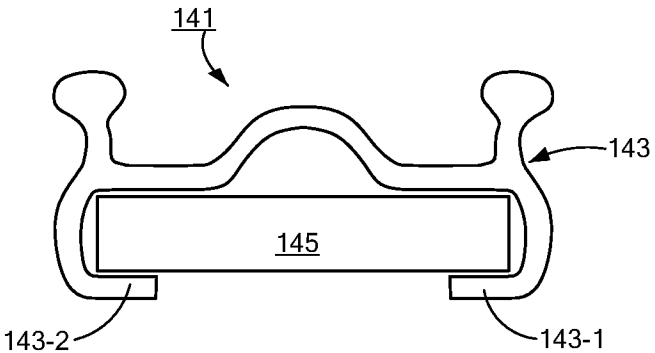

Referring back now to FIG. 1, system 11 may further comprise a plurality of substantially identical electrode assemblies 141, one such electrode assembly 141 being mounted within each of chambers 36-1 and 36-2 of stationary rail 13-1 and, although not shown in FIG. 1, one such electrode assembly 141 also being mounted within each of chambers 96-1 and 96-2 of traverse rail 15. (Instead of being mounted within each of chambers 36-1 and 306-2 of stationary rail 13-1, electrode assemblies 141 may alternatively be mounted within each of chambers 36-1 and 36-2 of stationary rail 13-2.) Each of electrode assemblies 141, one of which is also shown separately in FIGS. 16(*a*) and 16(*b*), may comprise a sleeve member 143 and an electrically-conductive strip 145. Sleeve member 143, which may be made of a non-electrically-conductive material, may be complementarily dimensioned to be slidably disposed within chambers 36-1, 36-2, 96-1 or 96-2. The sides 143-1 and 143-2 of sleeve 143 may be folded over in such a way as to keep strip 145 from falling out of sleeve 143. As will be discussed further below, electrode assemblies 141 may be used to help convey charge (e.g., alternating current or direct current), when needed, from an external source to hoist system 17 so as to recharge the battery of hoist system 17.

Figure 17:
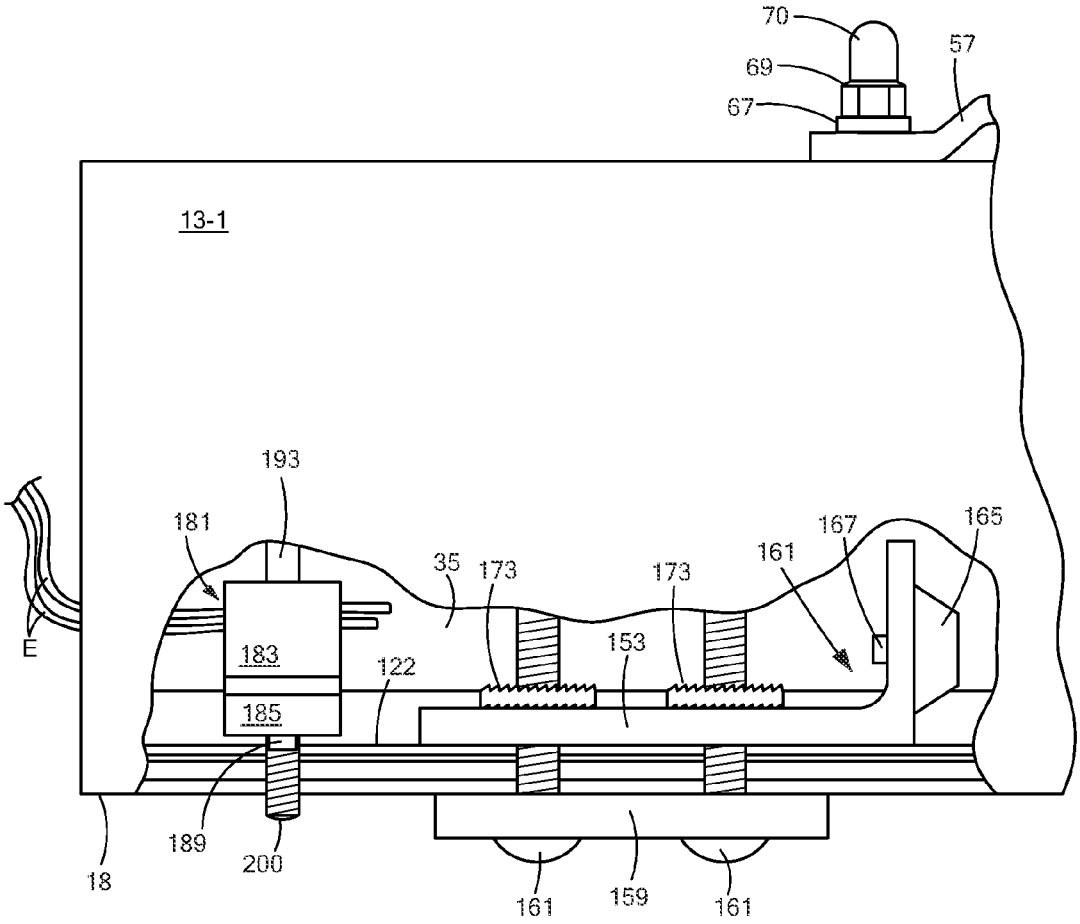
FIG. 17 is an enlarged fragmentary side view, broken away in part, of the system of FIG. 1.
Figure 18A:
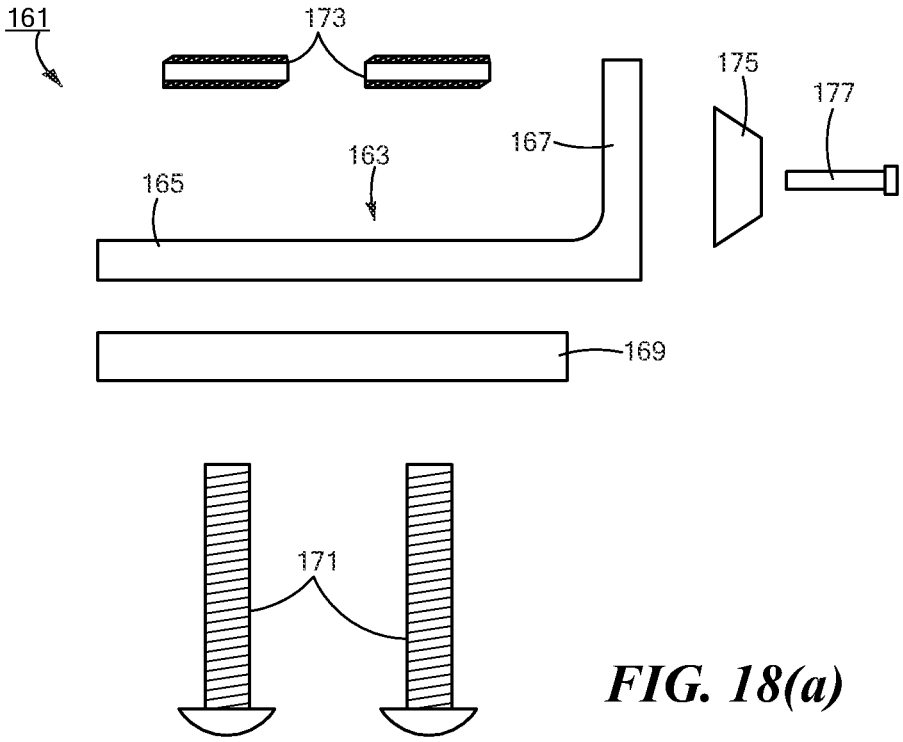
FIGS. 18(*a*) through 18(*d*) are exploded fragmentary side, side, top and bottom views, respectively, of the end stop shown in FIG. 17.
Figure 18B:
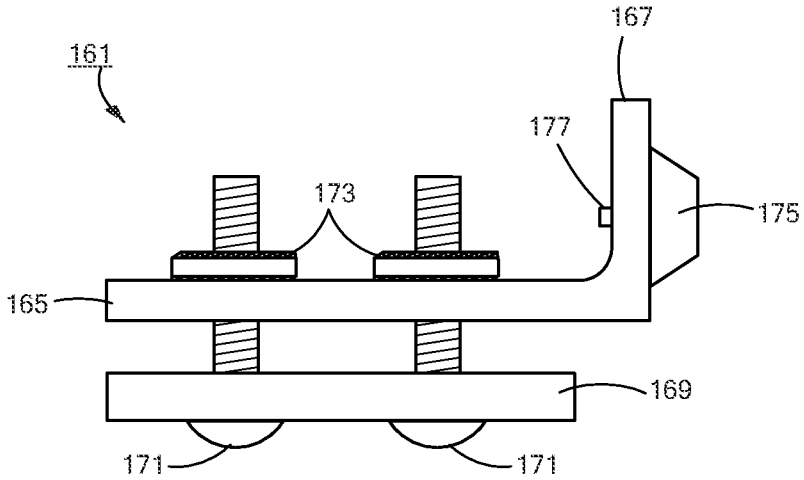
Figure 18C:
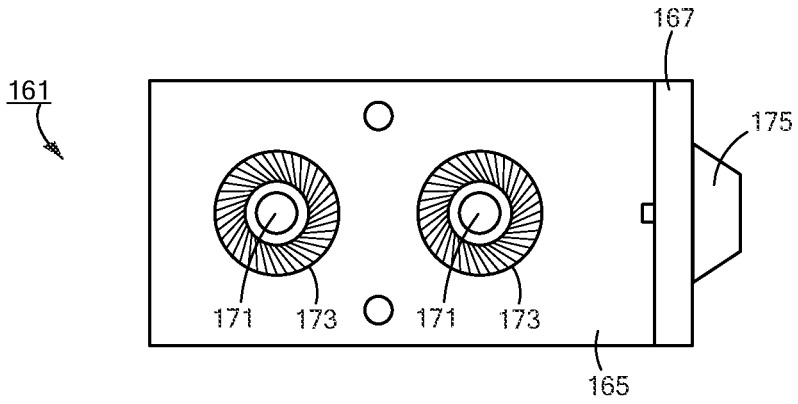
Figure 18D:
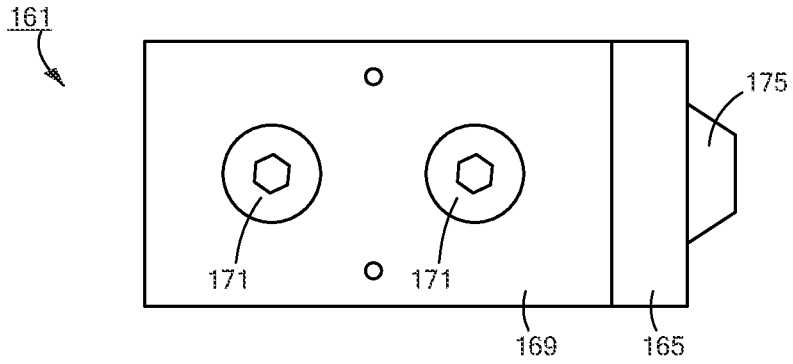

Referring now to FIG. 17, system 11 may further comprise a plurality of substantially identical end stops 161 (of which one is shown in FIG. 17). End stops 161 may be used to delimit the translational movement of trolley 113 within chamber 35 or to delimit the translational movement of a hoist system trolley within chamber 95, one such end stop 161 being mounted proximate to each end of each of stationary rail 13-1, stationary rail 13-2, and traverse rail 15. End stop 161, which is also shown separately in FIGS. 18(*a*) through 18(*d*), may comprise a one-piece, L-shaped bracket 163. Bracket 163, which may be made of a rigid material, may be shaped to comprise a horizontal portion 165 and a vertical portion 167. Bracket 163 may be appropriately dimensioned to fit within chamber 35 of rails 13-1 or 13-2 or within chamber 95 of rail 15, with horizontal portion 165 being adapted to sit on inner bottom surface 122 of chamber 35 or on inner bottom surface 124 of chamber 95 and with vertical portion 167 extending upwardly therefrom. End stop 161 may further comprise a generally rectangular plate 169, which may be used to fix bracket 163 to the rail. Plate 169 may be positioned flush against the bottom surface of bottom wall 18 of rails 13-1 or 13-2 (or against the bottom surface of bottom wall 77 of rail 15) and may be secured to bracket 163 using a pair of screws 171 and a corresponding pair of nuts 173. A bumper 175 may be mounted on vertical portion 167 of bracket 163 using a pin 177, bumper 175 serving to stop movement of trolley 113.

Figure 19B:
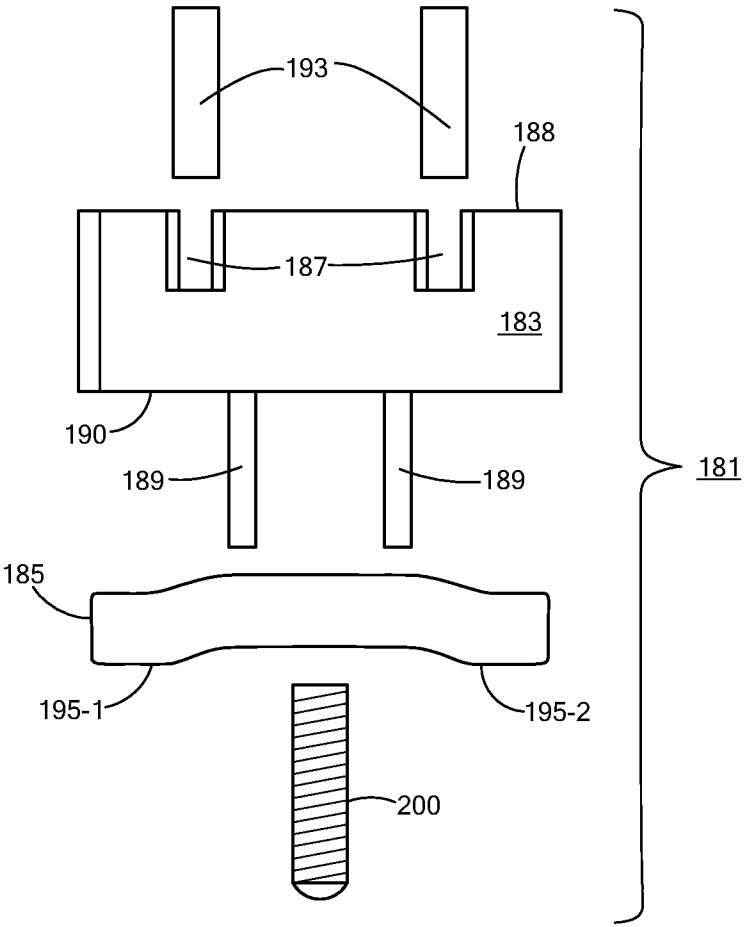
FIGS. 19(*a*) and 19(*b*) are front and exploded front views, respectively, of the electrode lock assembly shown in FIG. 17.
Figure 19A:
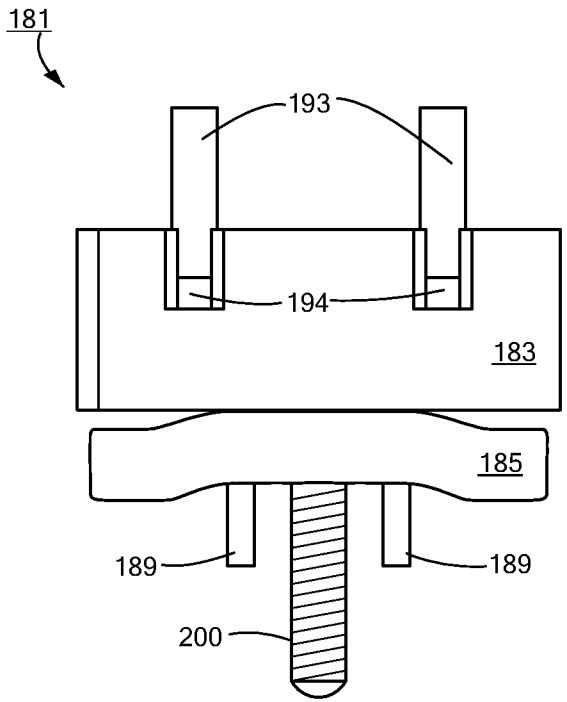
Figure 20A:
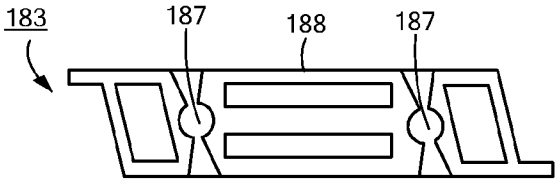
FIGS. 20(*a*) and 20(*b*) are top and bottom views, respectively, of the top piece of the electrode lock assembly shown in FIG. 17.
Figure 20B:
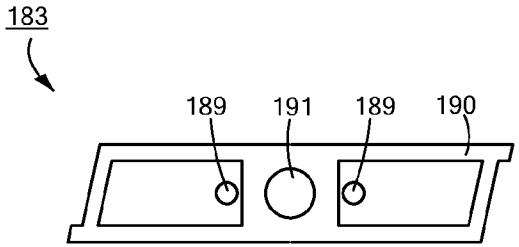
Figure 21:
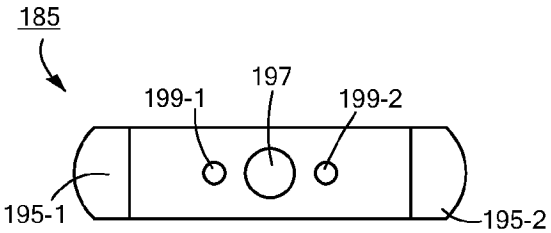
FIG. 21 is a top view of the bottom piece of the electrode lock assembly shown in FIG. 17.

System 11 may further comprise a plurality of electrode lock assemblies 181 for translationally fixing electrode assemblies 141 within their respective chambers 36-1, 36-2, 96-1 or 96-2 and for electrically coupling external electrical leads E to the electrically-conductive strips 145 within assemblies 141, one such assembly 181 being positioned at one end of each electrified rail (i.e., stationary rail 13-1 and traverse rail 15 in the present embodiment) between the end stop 161 and its corresponding nearby rail end. Assembly 181, which is also shown separately in FIGS. 19(*a*) and 19(*b*), may comprise a top piece 183 and a bottom piece 185. Top piece 183, which is also shown separately in FIGS. 20(*a*) and 20(*b*), may be a one-piece member shaped to include a pair of channels 187 extending downwardly a short distance from a top surface 188. In addition, top piece 183 may also be shaped to include a pair of posts 189 extending downwardly a short distance from a bottom surface 190 and a channel 191 positioned between posts 189 and extending upwardly a short distance from bottom surface 190. Channels 187 may be used to receive by a friction-fit a corresponding pair of electrically-conductive pins 193, channels 187 being dimensioned so that pins 193 cannot be fully inserted thereinto, but rather, form a pair of small windows 194 between the bottoms of pins 193 and the bottom ends of channels 187. Windows 194 may be used to receive external electrical leads from a power source in such a way that such external electrical leads are placed into electrical contact with pins 193. Bottom piece 185, which is also shown separately in FIG. 21, may be a one-piece member having an upwardly bowed shape. The ends 195-1 and 195-2 of piece 185 are adapted to be seated on bottom surface 122 of rails 13-1 or 13-2 or on bottom surface 124 of rail 15. Bottom piece 185 may also be shaped to include a central transverse opening 197 and a pair of flanking transverse openings 199-1 and 199-2. Openings 199-1 and 199-2 may be used to receive posts 189 of top piece 183, and opening 197 may be used to receive a set screw 200, the top end of which may be received in channel 191 of top piece 183. In this manner, by screwing screw 200, pins 193 may be forced up into contact with strips 145, thereby establishing electrical contact with strips 145 and also exerting sufficient pressure against strips 145 to prevent translational movement of electrode assemblies 141.

Figure 22A:
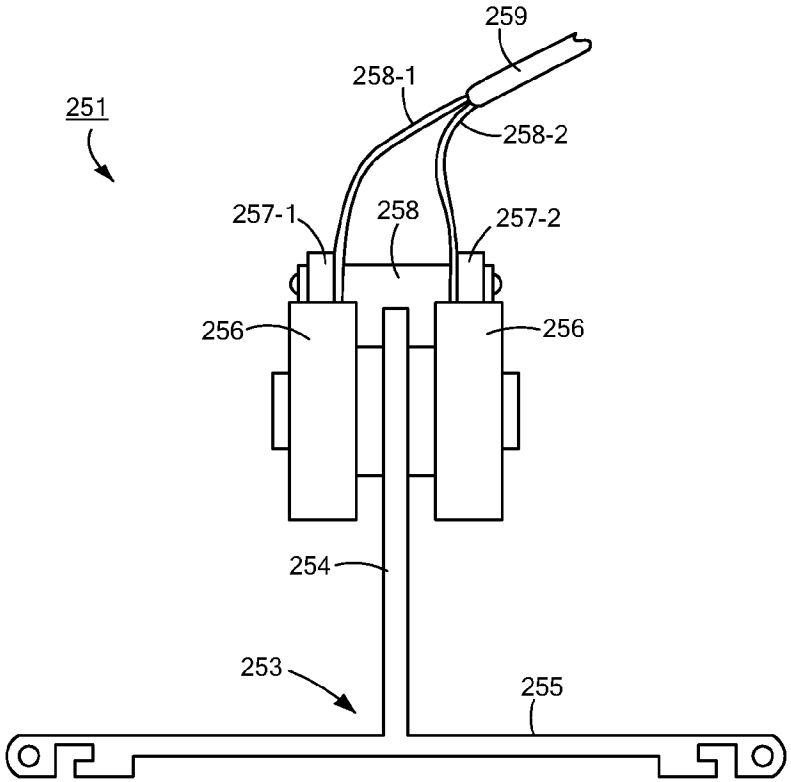
FIGS. 22(*a*) and 22(*b*) are enlarged fragmentary front and enlarged fragmentary side views, respectively, of the hoist system trolley shown in FIG. 1.
Figure 22B:
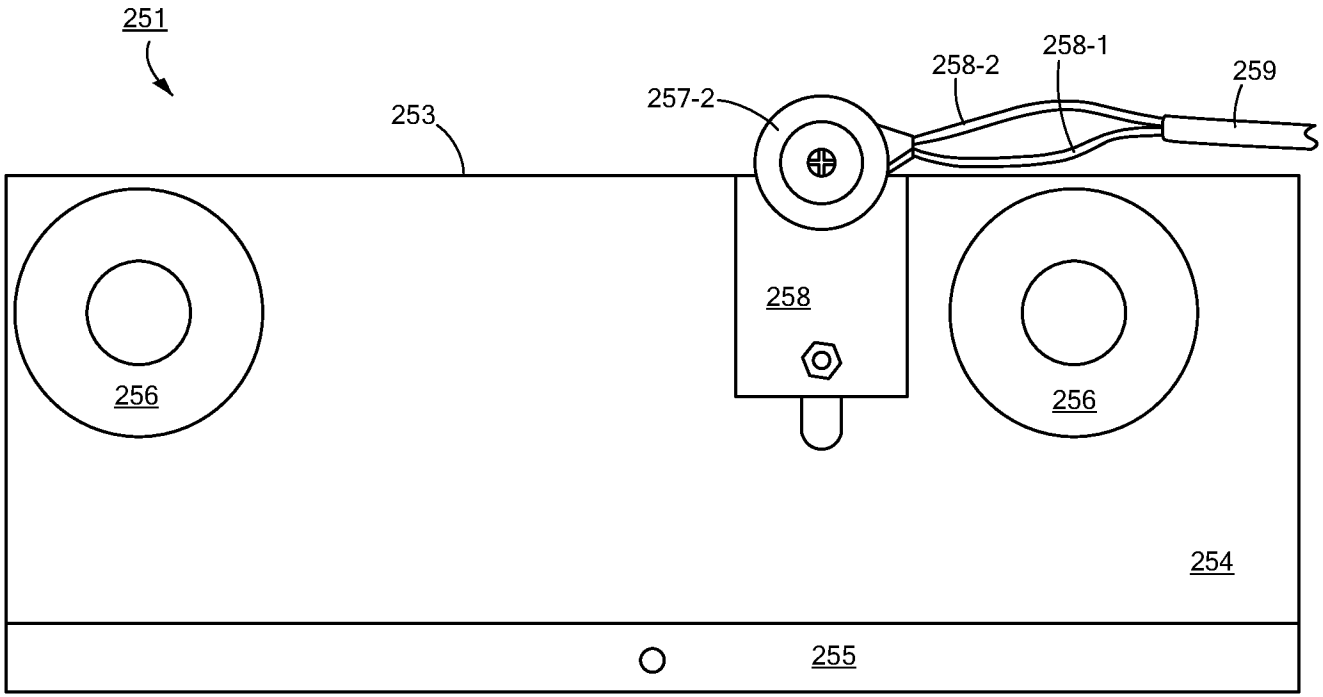

Referring back now to FIG. 1, hoist system 17 may be conventional in construction and may comprise a housing 211, a motor 212 housed within housing 211, a harness 213 adapted for attachment to a patient, and a movable belt 215, the lower end of movable belt 215 being coupled to harness 213, and the upper end of belt 215 being movable upwardly or downwardly, as desired, by motor 212. In addition, hoist system 17 may additionally comprise a trolley 251 that is fixed to the top of housing 211 and that rides back and forth within chamber 95 of traverse rail 15. Referring now to FIGS. 22(*a*) and 22(*b*), one embodiment of trolley 251 is shown separately, it being understood that, depending on the particulars of hoist system 17, trolley 251 may be modified accordingly. Trolley 251 may comprise a bracket 253. Bracket 253, which may be a one-piece, T-shaped structure made of a strong material, such as steel, may comprise a substantially vertical portion 254 and a substantially horizontal portion 255. Horizontal portion 255 may be fixed to the top of housing 211 by means not shown. A plurality of wheels 256, which may be made of plastic or another suitable material, may be rotatably mounted on vertical portion 254. Wheels 256 and vertical portion 254 may be appropriately dimensioned so that wheels 256 may ride along the inner bottom surface 124 of chamber 95 of traverse rail 15, with vertical portion 254 extending through the corresponding slit 97 of traverse rail 15. Trolley 251 may further comprise a pair of electrically-conductive contact wheels 257-1 and 257-2, which may be used to make contact with electrode assemblies 141 in chambers 96-1 and 96-2, respectively. Wheels 257-1 and 257-2 may be rotatably mounted on a clip 258 that, in turn, may be slidably mounted in a vertical direction on vertical portion 254, clip 258 being urged upwardly by a spring (not shown). Wheels 257-1 and 257-2 may be electrically coupled to electrical leads 258-1 and 258-2, respectively. Leads 258-1 and 258-2 may be bundled in a cable 259 that may be fed to the battery of hoist system 17.

To use system 11, a caregiver may attach harness 213 to a patient and then may operate motor 212 in such a fashion as to cause belt 215 to be raised, thereby causing the patient also to be raised. (If harness 213 is not initially positioned close enough to the patient for attachment, the caregiver may manually slide traverse rail 15 relative to stationary rails 13-1 and 13-2 and/or may manually slide hoist system 17 relative to traverse 15 until harness 213 is positioned sufficiently close to the patient for attachment.) With the patient thus raised and still attached to harness 213, the patient may then move, or be moved with assistance from the caregiver, by manually sliding hoist system 17 along traverse rail 15 and/or by manually sliding traverse rail 15 relative to stationary rails 13-1 and 13-2. Once the patient has reached a desired destination, motor 212 may be operated so as to cause belt 215 to be lowered, thereby causing the patient also to be lowered, and the patient may thereafter be removed from harness 213.

It is to be understood that, although system 11 is discussed herein as having a rail system that comprises a pair of parallel stationary rails 13-1 and 13-2 and a traverse rail 15, system 11 may additionally include other components as part of a rail system. Such components may include, but are not limited to, additional straight or curved stationary rails, additional traverse rails, turntables, switch tracks, etc.

Figure 23:
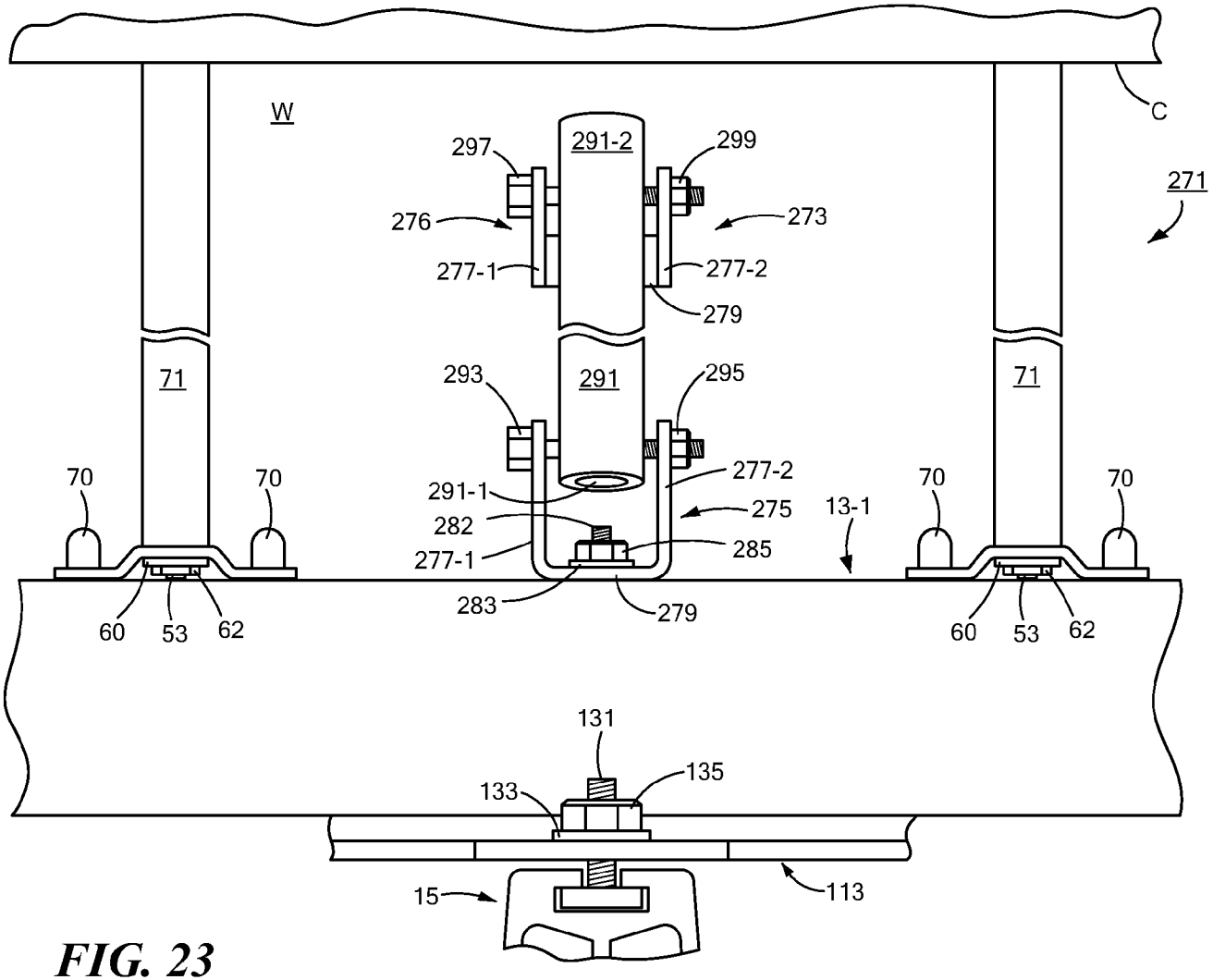
FIG. 23 is a fragmentary side view of a second embodiment of a patient positioning system constructed according to the teachings of the present invention, with one of the stationary rails and certain other components of the patient positioning system not being shown for the sake of clarity.
Figure 24A:
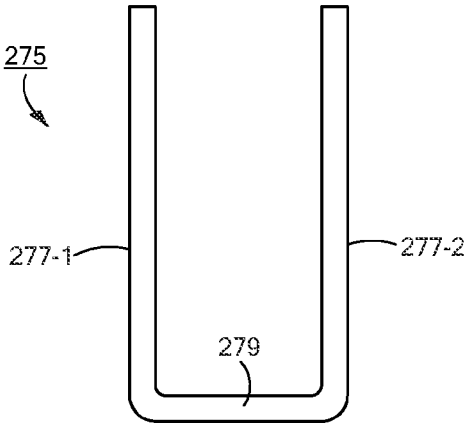
FIGS. 24(*a*) through 24(*d*) are front, left side, right side and top views, respectively, of one of the stabilizer brackets shown in FIG. 23.
Figure 24B:
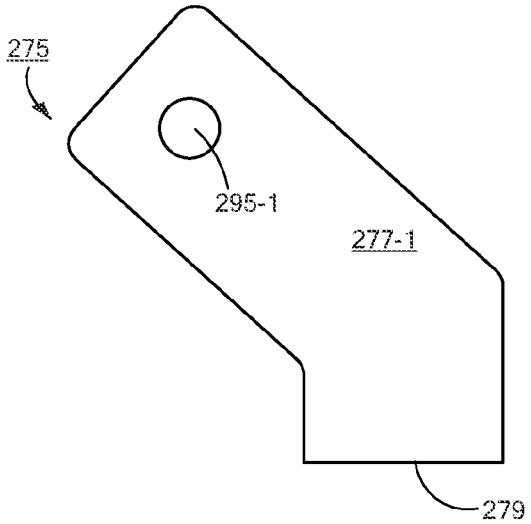
Figure 24C:
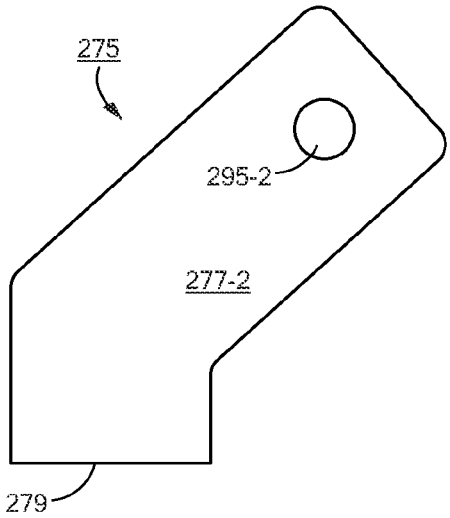
Figure 24D:
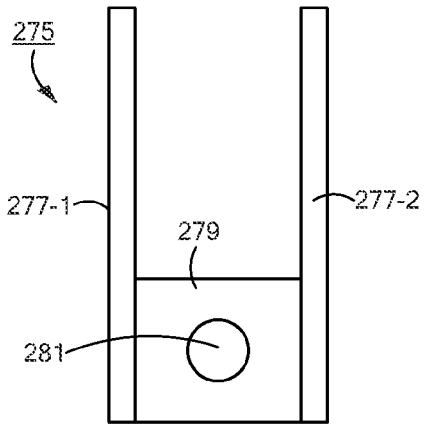

Referring now to FIG. 23, there is shown a fragmentary side view of a second embodiment of a patient positioning system constructed according to the teachings of the present invention, said patient positioning system being represented generally by reference numeral 271. Certain components of system 271, such as, but not limited to one of the stationary rails, the hoist system, and electrical leads, are not shown for the sake of clarity.

System 271 may be similar in most respects to system 11, the principal difference between the two systems being that system 271 may additionally comprise a stabilizer assembly 273 for mechanically coupling stationary rail 13-1 to a building structure, which building structure may be, but is not limited to, a vertical side wall W of a room. Stabilizer assembly 273 may comprise a pair of identical stabilizer brackets 275 and 276. Bracket 275, which is also shown separately in FIGS. 24(*a*) through 24(*b*), may be a unitary member made of a strong material, such as steel, and may be shaped to include a pair of angled arms 277-1 and 277-2 interconnected by a bridge 279. A transverse opening 281 may be provided in bridge 279, and bracket 275 may be secured to the top of stationary rail 13-1 by inserting the head of a T-bolt 282 similar to T-bolt 61 down into channel 27 of rail 13-1, turning the T-bolt 282 ninety degrees to lock the head within channel 27, passing the free end of T-bolt 282 through opening 281 in bracket 275, and then retaining bracket 275 against T-bolt 282 using a washer 283 similar to washer 67 and a nut 285 similar to nut 69. Bracket 276 may be fixed to wall W by positioning the bottom surface of bridge 279 flush against wall W and then coupling bridge 279 to wall W through opening 281 using suitable hardware (not shown), such as a toggler bolt and screw.

Stabilizer assembly 273 may further comprise a tubular post 291, which may be similar in construction and composition to post 71 but may be shorter in length. A first end 291-1 of post 291 may be coupled to bracket 275 using a threaded bolt 293 inserted through openings 295-1 and 295-2 in arms 277-1 and 277-2, respectively, as well as transversely through post 291. Bolt 293 may be retained using a nut 295. A second end 291-2 of post 291 may be coupled to bracket 276 using a threaded bolt 297 inserted through openings 295-1 and 295-2 in arms 277-1 and 277-2, respectively, as well as transversely through post 291. Bolt 297 may be retained using a nut 299.

It should be understood that, although stabilizer assembly 273 is shown in the present embodiment with bracket 275 attached to rail 13-1 and with bracket 276 attached to wall W, bracket 275 could alternatively be attached to post 71 and/or bracket 276 could alternatively be attached to a ceiling structure.

Figure 25:
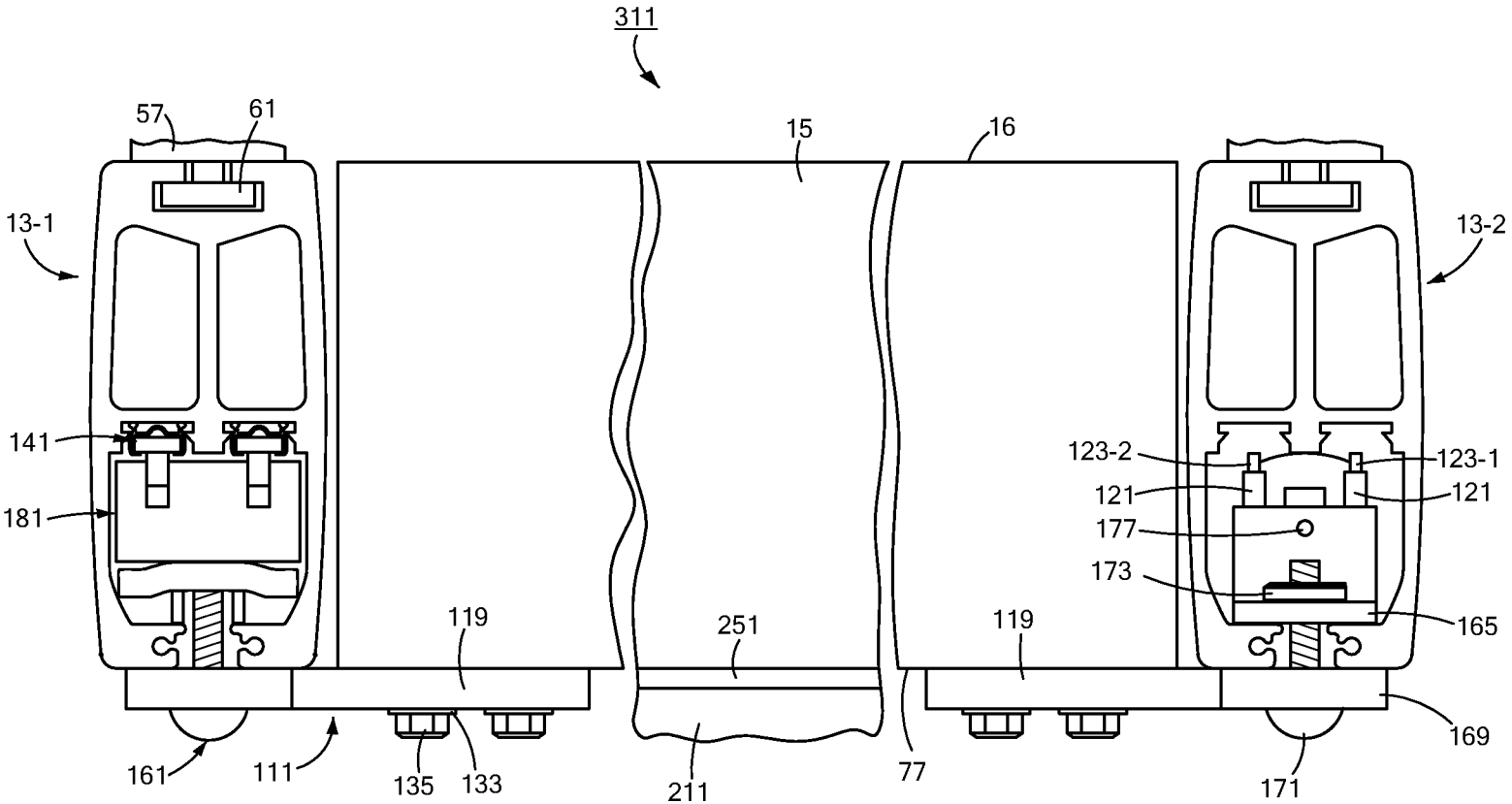
FIG. 25 is a fragmentary front view, broken away in part, of a third embodiment of a patient positioning system constructed according to the teachings of the present invention, certain components of the patient positioning system not being shown for the sake of clarity.

Referring now to FIG. 25, there is shown a fragmentary front view, broken away in part, of a third embodiment of a patient positioning system constructed according to the teachings of the present invention, said patient positioning system being represented generally by reference numeral 311. Certain components of system 311, such as, but not limited to, electrical leads, are not being shown for the sake of clarity.

System 311 may be similar in most respects to system 11, the principal difference between the two systems being that, whereas, in system 11, top wall 16 of traverse rail 15 may be positioned up against the bottom surface of horizontal portion 119 of bracket 115, by comparison, in system 311, bottom wall 77 of traverse rail 15 may be seated on top of the bottom surface of horizontal portion 119, with the heads of bolts 131 (not shown in FIG. 25) seated on top of bottom surface 124 of traverse rail 15. As can be appreciated, one advantage of system 311 over system 11 is that system 311 may present a more compact assembly of rails than may system 11.

Figure 26:
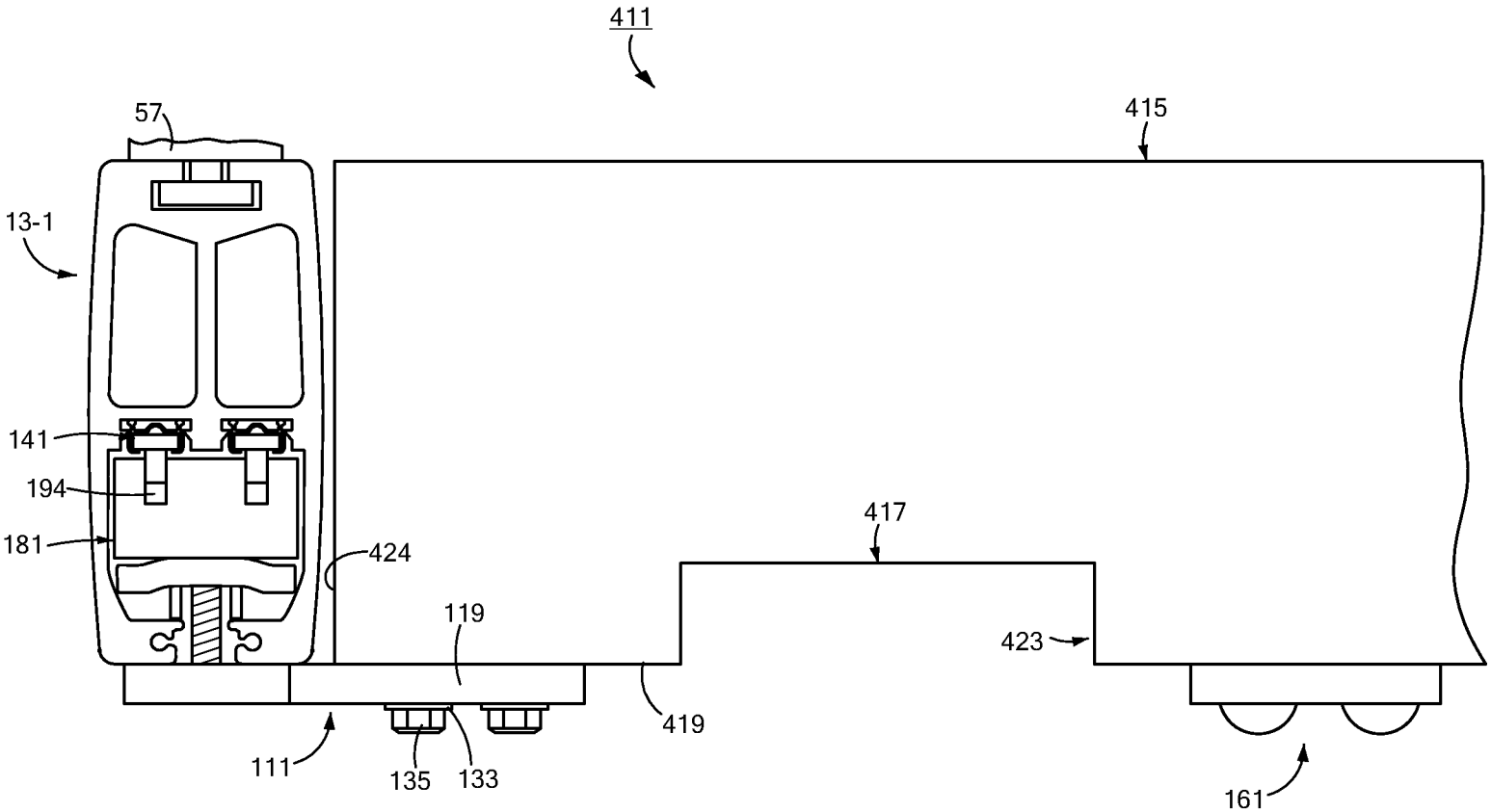
FIG. 26 is an enlarged fragmentary front view, of a fourth embodiment of a patient positioning system constructed according to the teachings of the present invention, certain components of the patient positioning system not being shown for the sake of clarity.

Referring now to FIG. 26, there is shown an enlarged fragmentary front view of a fourth embodiment of a patient positioning system constructed according to the teachings of the present invention, said patient positioning system being represented generally by reference numeral 411. Certain components of system 411, such as, but not limited to, electrical leads, are not being shown for the sake of clarity.

System 411 may be similar in most respects to system 311, the principal difference between the two systems being that, whereas system 311 may include traverse rail 15, system 411 may include a traverse rail 415. Traverse rail 415 may be similar in most respects to traverse rail 15, the principal difference between the two traverse rails being that traverse rail 415 may be shaped to include a cutout portion 417, where a length of bottom wall 419 and adjacent portions of the side walls of rail 415 have been removed to permit access from below to the contents of lower chamber 423. Cutout 417 may be appropriately dimensioned so that a traverse rail trolley mounted within rail 415 may be withdrawn from lower chamber 423 through cutout 417 (after first removing end stop 161 and electrode lock assembly 181 (which is not shown in FIG. 26)), as opposed to being removed through end 424 of rail 415 (which would first require that end stop 161 and electrode lock assembly 181 be removed and would then require that rail 415 be decoupled from rail 13-1 and then tipped to permit access to lower chamber 423 from end 424). System 411 is, therefore, advantageous in that the hoist system trolley may be easily decoupled from traverse rail 415, thereby facilitating repairs to the hoist system. In addition, system 411 is also advantageous in that it readily permits a plurality of hoist systems to be coupled to a single traverse rail, for example, to hold greater loads.

Figure 27A:
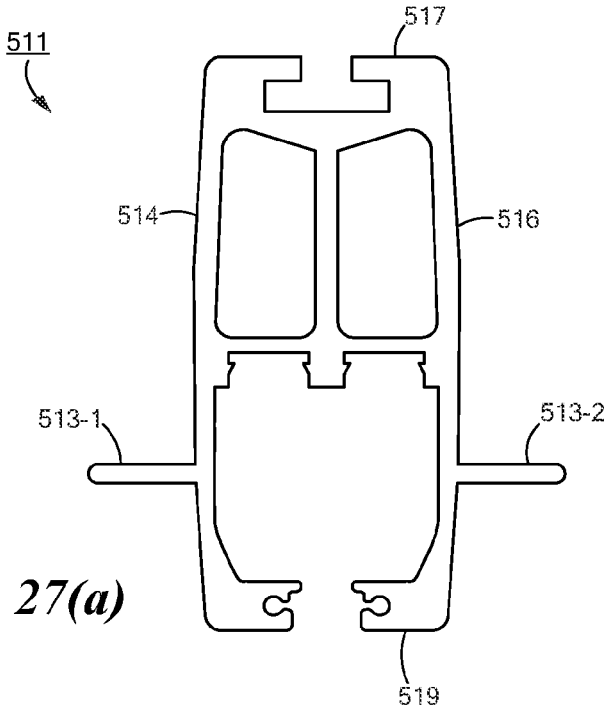
FIGS. 27(*a*) and 27(*b*) are end and side views, respectively, of an alternate embodiment of a stationary rail that may be used in the system of FIG. 1.
Figure 27B:
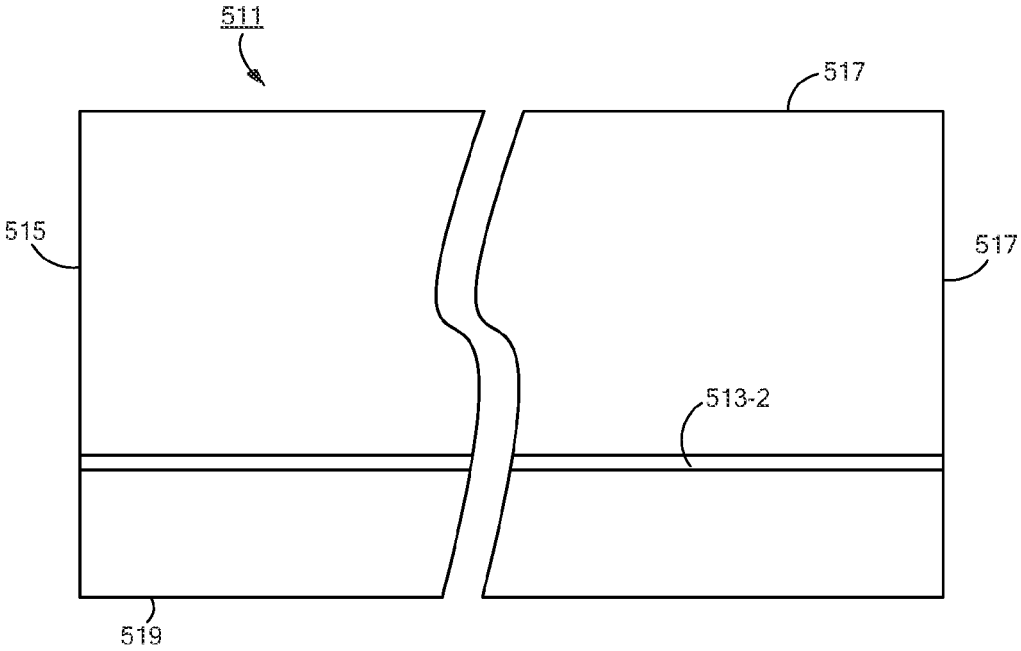

Referring now to FIGS. 27(*a*) and 27(*b*), there are shown end and side views, respectively, of a first alternate embodiment of a rail that may be used in system 11, said first alternate embodiment being represented generally by reference numeral 511.

Rail 511, which is a stationary rail that may be used instead of one or both of rails 13-1 and 13-2, is similar in most respects to stationary rails 13-1 and 13-2, the principal difference between the two types of rails being that stationary rail 511 may additionally include a pair of integral flanges 513-1 and 513-2. Flange 513-1 may extend laterally away from a left side wall 514 and may extend from a front end 515 of rail 511 to a rear end 517 of rail 511. Flange 513-2 may extend laterally away from a right side wall 516 and may extend from a front end 515 of rail 511 to a rear end 517 of rail 511. While not being limited to any particular dimensions, rail 511 may have generally the same set of dimensions discussed above for rail 13-1, except that flanges 513-1 and 513-2 may be positioned between a top wall 517 and a bottom wall 519 so that the top surfaces of flanges 513-1 and 513-2 may be about 1.250 inches from the bottom surface of bottom wall 519. In addition, flange 513-1 may extend laterally away from wall 514 for about 0.750 inch, and flange 513-2 may extend laterally away from wall 516 for about 0.750 inch.

Figure 28:
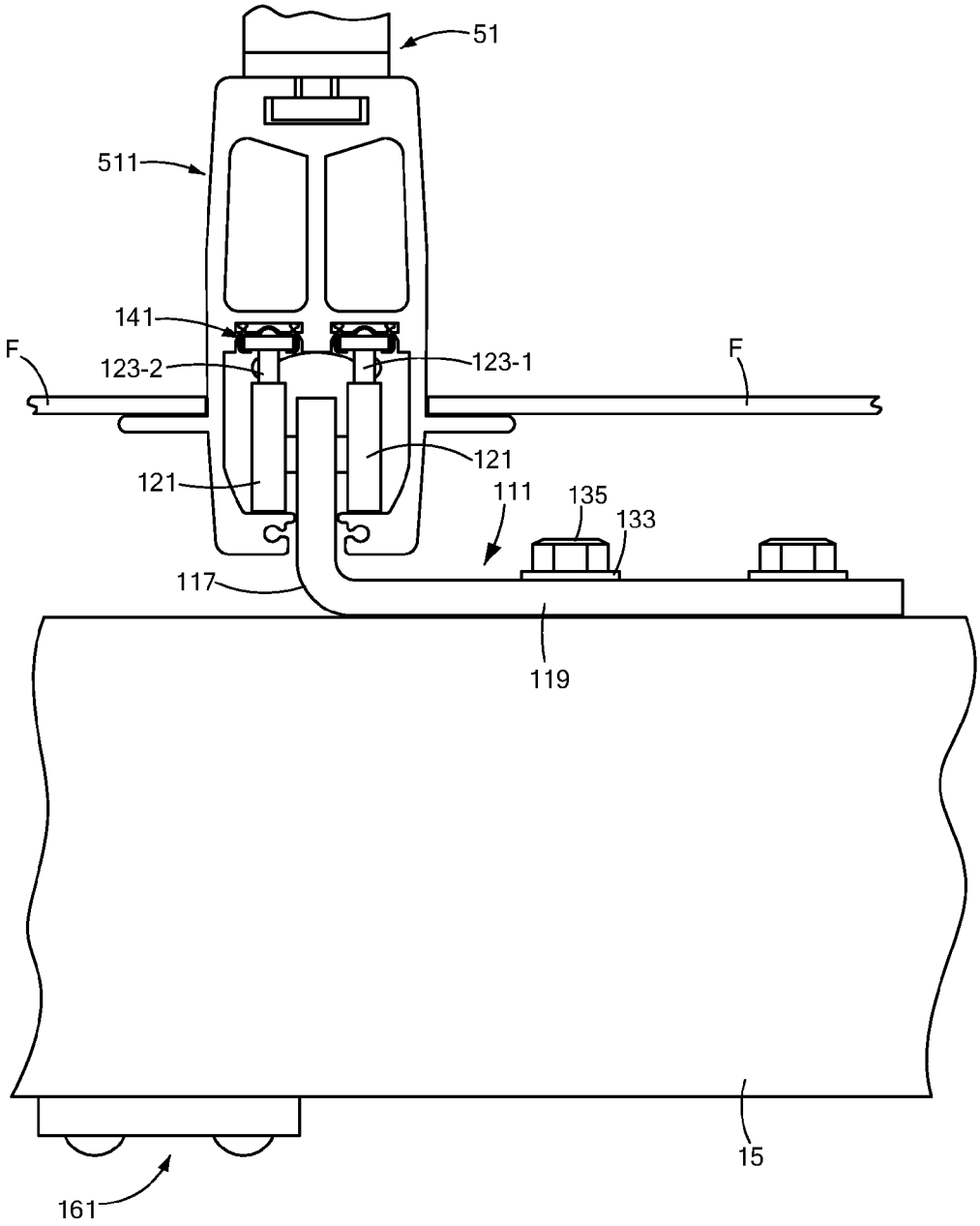
FIG. 28 is a fragmentary front view of a patient positioning system including the alternate stationary rail of FIGS. 27(*a*) and 27(*b*), the patient positioning system being shown mounted in a ceiling in a recessed fashion, certain components of the patient positioning system not being shown for the sake of clarity.

As can be seen in FIG. 28, flanges 513-1 and 513-2 may be used to mount rail 511 in a ceiling in a recessed fashion, with a frame F for ceiling tiles being seated on flanges 513-1 and 513-2. In this manner, much of stationary rail 511 (as well as mounting assemblies 51) may be positioned above the ceiling, which may be more aesthetically pleasing to a patient and/or to caregivers.

Figure 29:
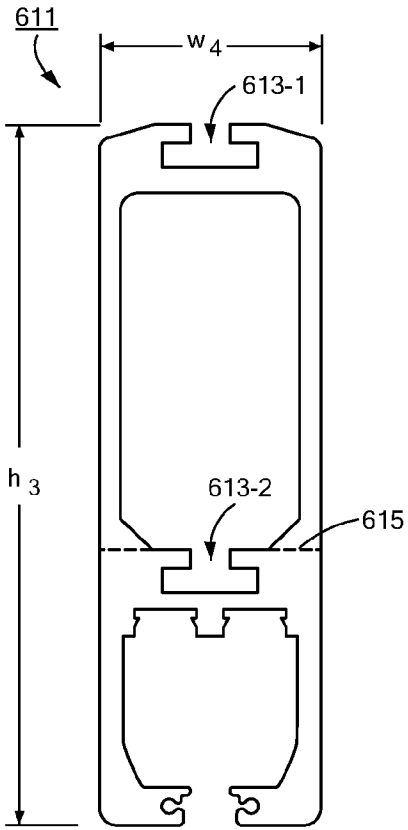
FIG. 29 is an end view of another alternate embodiment of a rail that may be used in the system of FIG. 1.

Referring now to FIG. 29, there is shown an end view of a second alternate embodiment of a rail that may be used in system 11, said second alternate embodiment being represented generally by reference numeral 611.

Rail 611 may be used in place of one or both of stationary rails 13-1 and 13-2 and/or in place of traverse rail 15. As can be seen, rail 611 may be shaped to include an upper longitudinal channel 613-1 having an inverted T-shape and a lower longitudinal channel 613-2 having an inverted T-shape. Due to the construction of rail 611, a top portion of rail 611 may be cut away along imaginary line 615 for at least a portion of its length, with lower channel 613-2 thereafter being used like channel 27 (if rail 611 is being used as a stationary rail) or like channel 87 (if rail 611 is being used as a traverse rail). This may be advantageous if rail 611 is to be attached to certain components like a turntable (not shown). While not being limited to any particular dimensions, rail 611 may have a height $h_3$ of about 6.700 inches and a width $w_4$ of about 2.100 inches. Rail 611 may have a weight of approximately 5.651 lbs/ft (or approximately 8.410 kg/m).

Figure 30B:
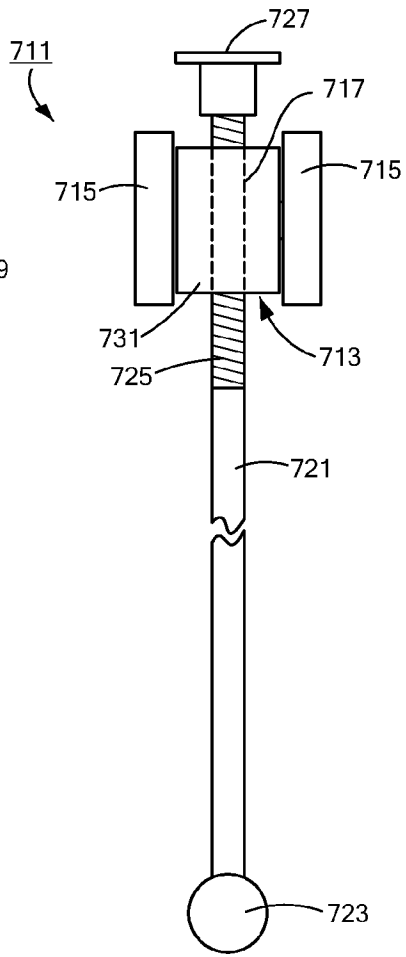
FIGS. 30(*a*) and 30(*b*) are side and end views, respectively, of a brake that may be used in the system of FIG. 1.
Figure 30A:
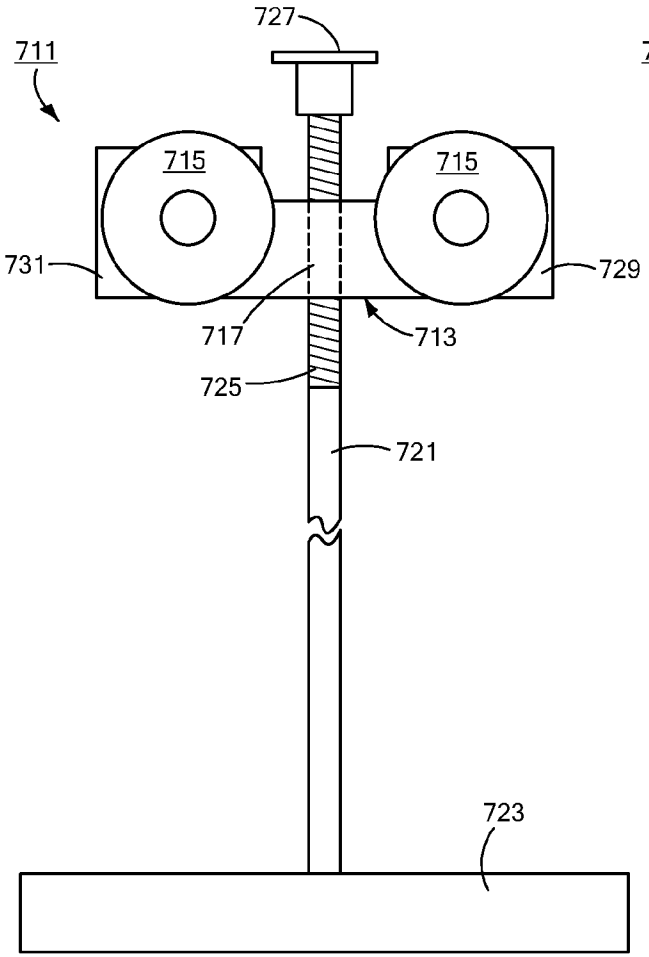

Referring now to FIGS. 30(*a*) and 30(*b*), there are shown side and end views, respectively, of one embodiment of a brake that may be used in system 11, said brake being represented generally by reference numeral 711.

Brake 711 may comprise a one-piece block 713, on which a plurality of wheels 715 are rotatably mounted. Block 713 and wheels 715 may be appropriately dimensioned to fit within chamber 95 of traverse rail 15, with wheels 715 being adapted to ride along the top of bottom surface 124 of traverse rail 15. Block 713 may include an internally threaded bore 717 (shown in phantom).

Brake 711 may additionally include an externally threaded rod 721. The bottom end of rod 721 may be fixedly coupled to a handle 723. A portion 725 of rod 721 may be threadingly engaged with bore 717 of block 713. A nut (not shown) may be screwed onto the top end of rod 721, and a cap 727 may be fixedly mounted over the nut.

In use, block 713 and wheels 715 may be inserted into chamber 95 of rail 15, with wheels 715 riding along the top of bottom surface 124 of rail 15 and with cap 727 out of contact with the top surface of chamber 95. Using handle 723, block 713 may then be rolled into position translationally within chamber 95 so that a front end 729 of block 713 (or a rear end 731 of block 713, depending on which end of rail 15 block 713 was inserted) abuts trolley 251 (or abuts any other object within chamber 95 whose translational movement one wishes to restrict). Using handle 723, rod 721 may then be screwed upwardly relative to block 713 until cap 727 comes into tight engagement with the top surface of chamber 95, thereby impeding translational movement of block 713, as well as preventing trolley 251 from moving in the direction of block 713. Thereafter, if one wishes to remove the restraint provided by brake 711, rod 721 may be screwed downwardly relative to block 713 until cap 727 is no longer in tight engagement with the top surface of chamber 95.

As can be appreciated, an additional brake 711 may be placed on the opposite side of trolley 251 to keep trolley 251 from moving translationally in both directions. Also, as can be appreciated, block 713 and wheels 715 may be inserted into chamber 35 of either rail 13-1 or rail 13-2 if one wishes to delimit the movement of trolley 113.

Figure 31A:
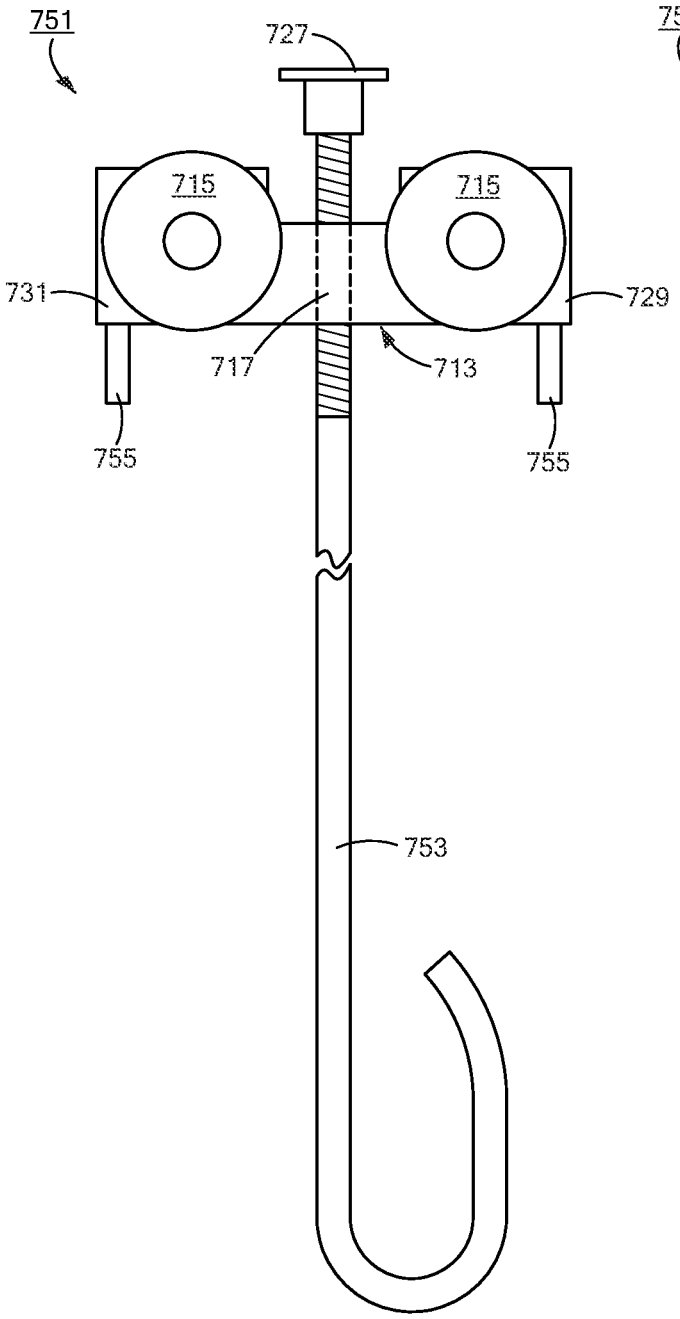
FIGS. 31(*a*) and 31(*b*) are side and end views, respectively, of an intravenous (IV) trolley that may be used in the system of FIG. 1.
Figure 31B:
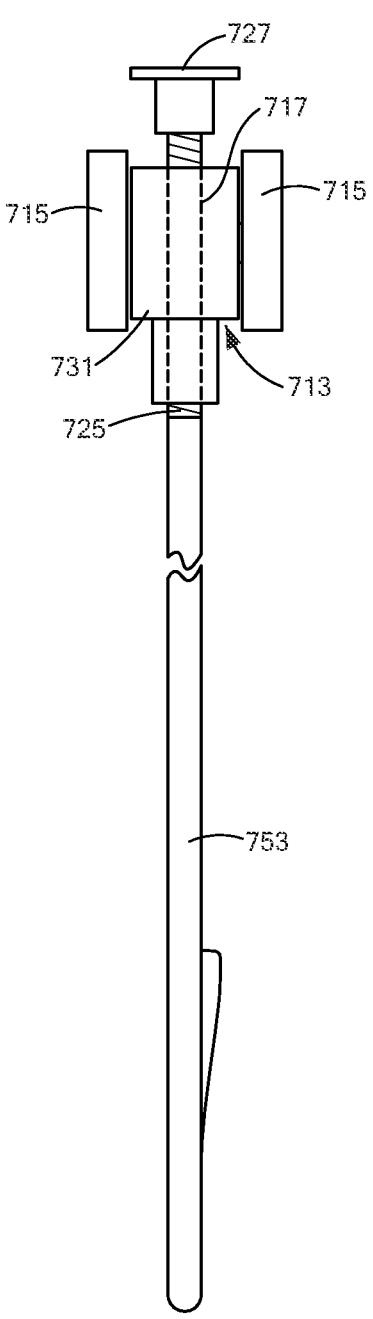

Referring now to FIGS. 31(*a*) and 31(*b*), there are shown side and end views, respectively, of one embodiment of an intravenous (IV) trolley that may be used in system 11, said IV trolley being represented generally by reference numeral 751.

IV trolley 751 may be similar in most respects to brake 711, the principal difference between the two devices being that, whereas brake 711 may comprise a straight rod 721 and a handle 723, IV trolley 751 may instead comprise a hook 753 adapted to hold an IV bag or the like. Trolley 751 may also comprise a pair of guides 755, which may serve to keep trolley 751 aligned within traverse rail 15.

As can be appreciated, IV trolley 751 may function both as a brake and as a IV bag holder.

Figure 32A:
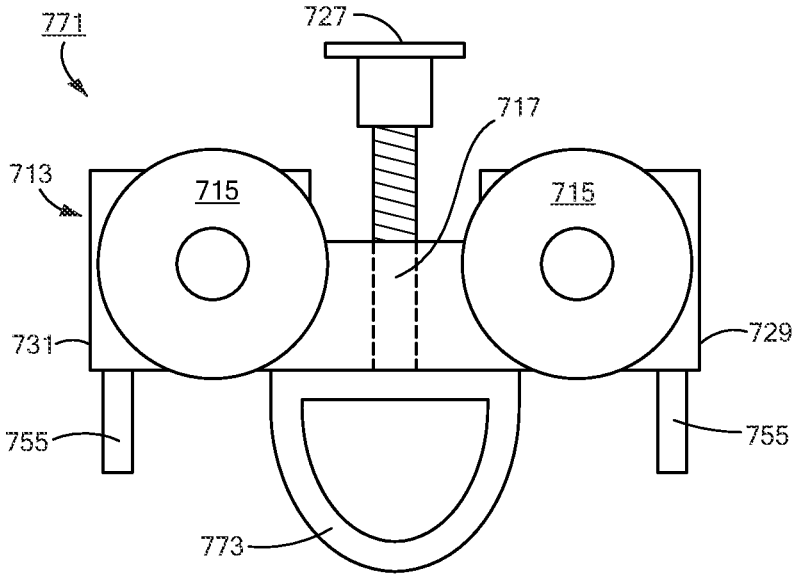
FIGS. 32(*a*) and 32(*b*) are side and end views, respectively, of a portable motor trolley that may be used in the system of FIG. 1.
Figure 32B:
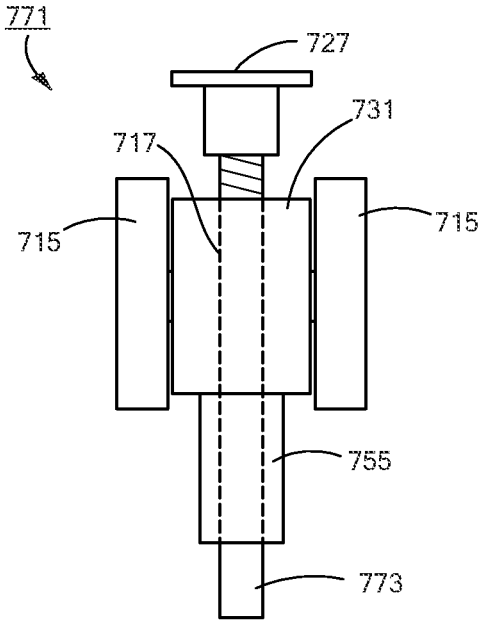

Referring now to FIGS. 32(*a*) and 32(*b*), there are shown side and end views, respectively, of one embodiment of a portable motor trolley that may be used in system 11, said portable motor trolley being represented generally by reference numeral 771.

Portable motor trolley 771 may be similar in most respects to IV trolley 751, the principal difference between the two devices being that, whereas IV trolley 751 may comprise a hook 753 adapted to hold an IV bag or the like, portable motor trolley 771 may instead comprise a loop 773 to which a ring clasp secured to a portable hoist motor may be removably attached. The attachment of a portable hoist motor to traverse rail 15 may be desirable, for example, if one wishes to use a plurality of motors to hoist a heavy load or if the primary hoist motor becomes inoperative.

As can be appreciated, portable motor trolley 771 may function both as a brake and as a portable motor holder.

Figure 33A:
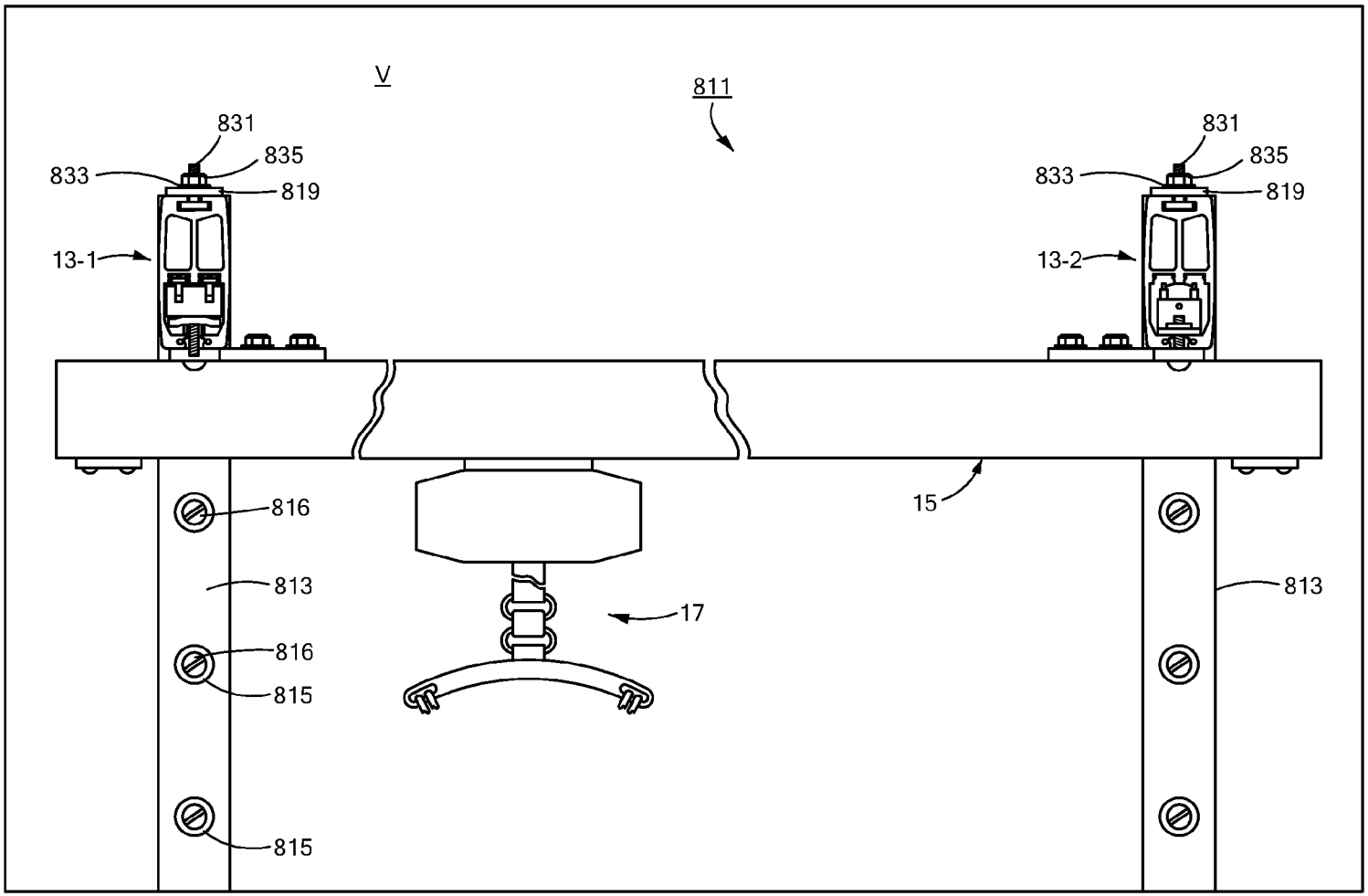
FIGS. 33(*a*) and 33(*b*) are front and fragmentary side views, respectively, of a fifth embodiment of a patient positioning system constructed according to the teachings of the present invention, certain components of the patient positioning system not being shown for the sake of clarity.
Figure 33B:
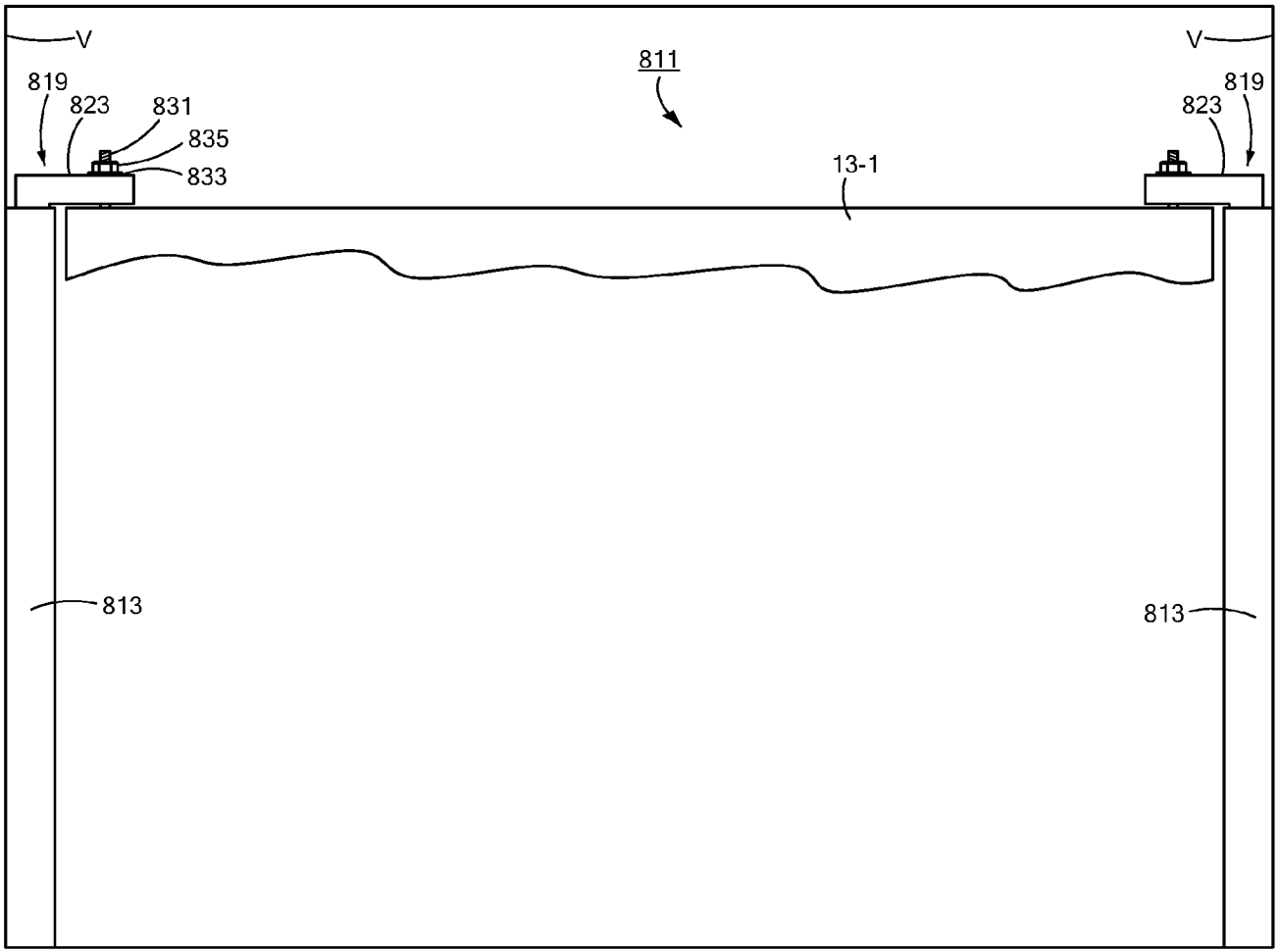

Referring now to FIGS. 33(*a*) and 33(*b*), there are shown front and fragmentary side views, respectively, of a fifth embodiment of a patient positioning system constructed according to the teachings of the present invention, said patient positioning system being represented generally by reference numeral 811. Certain components of system 811, such as, but not limited to, electrical leads, are not being shown for the sake of clarity.

Figure 34A:
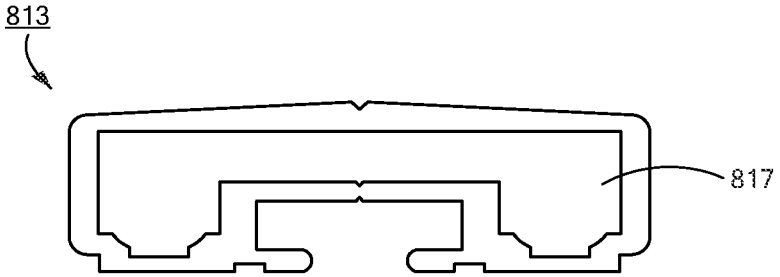
FIGS. 34(*a*) and 34(*b*) are top and end views, respectively, of one of the wall studs shown in FIGS. 33(*a*) and 33(*b*)
Figure 34B:
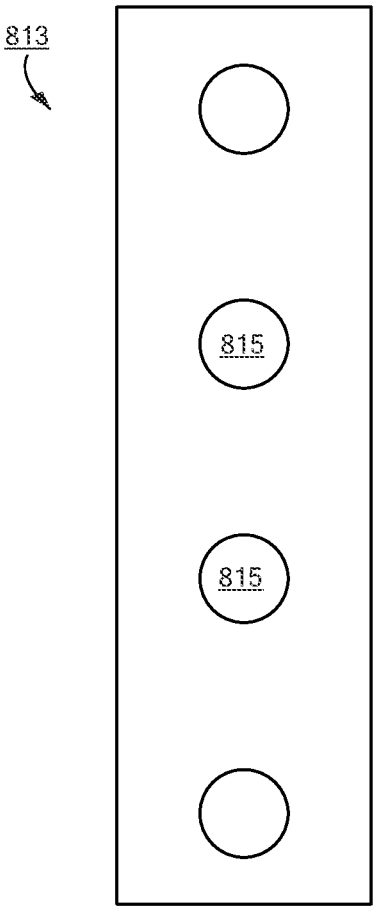

System 811 is similar in many respects to system 11, the principal difference between the two systems being that, whereas system 11 may comprise a plurality of mounting assemblies 51 for fixedly securing stationary rails 13-1 and 13-2 to a ceiling structure, system 811 may instead comprise means for fixedly mounting stationary rails 13-1 and 13-2 on one or more vertical walls V. In the present embodiment, said mounting means may comprise four identical wall studs 813 (of which only three are shown), a first pair of wall studs 813 being mounted on one vertical wall and a second pair of wall studs 813 being mounted on an opposite vertical wall, with one wall stud 813 on each wall being aligned with a wall stud 813 on the opposing wall. Each wall stud 813 (one wall stud 813 also being shown separately in FIGS. 34(*a*) and 34(*b*)) may be an elongated, one-piece member made of a strong material, such as extruded aluminum. A plurality of transverse openings 815 may be spaced along the length of each wall stud 813. Each wall stud 813 may be fixed to its respective wall, for example, by drilling a hole into the wall in alignment with each of openings 815, inserting a toggler bolt (not shown) into each of the drilled holes, and screwing a machine screw 816 through each opening 815 and into its corresponding toggler bolt. For reasons to become apparent below, stud 813 is shaped to include a longitudinal cavity 817.

Figure 35A:
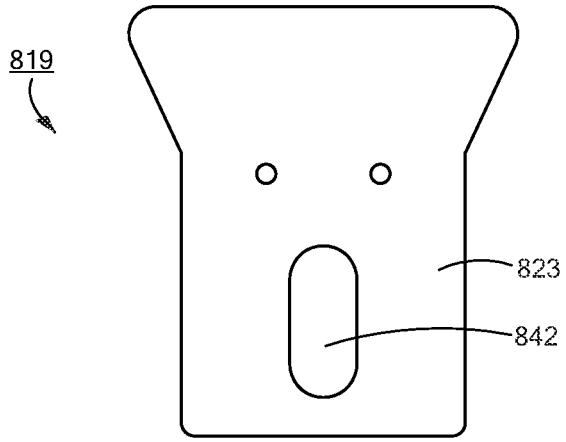
FIGS. 35(*a*) and 35(*b*) are top and end views, respectively, of one of the wall stud brackets shown in FIGS. 33(*a*) and 33(*b*)
Figure 35B:
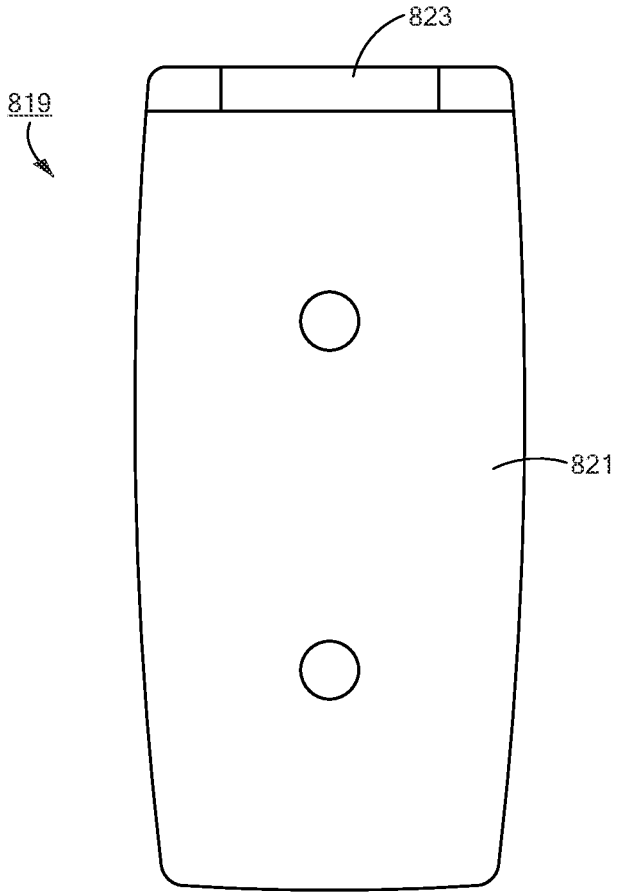

Said mounting means may further comprise four identical wall stud brackets 819 (of which only three are shown in FIGS. 33(*a*) and 33(*b*)). Each wall stud bracket 819, one of which is shown separately in FIGS. 35(*a*) and 35(*b*), may be a generally L-shaped, one-piece member comprising a vertical portion 821 and a horizontal portion 823. Vertical portion 821 may be inserted into cavity 817 of wall stud 813 and may be retained therewithin by a frictional fit, with horizontal portion 823 extending in the direction of the opposite wall.

Said mounting means may further comprise hardware for securely coupling the brackets 819 on opposite wall studs 813 to the same stationary rail 13-1 or to the same stationary rail 13-2. In the present embodiment, said hardware may comprise a pair of T-bolts 831, a pair of washers 833, and a pair of nuts 835. T-bolts 831 may be identical to T-bolt 131, washers 833 may be identical to washer 133, and nuts 835 may be identical to nut 135. Each T-bolt 831 may be appropriately dimensioned so that its head may sit within channel 27 of rail 13-1 or rail 13-2 and so that its free end may pass through a transverse opening 842 provided in horizontal portion 823 of bracket 819 and may thereafter be retained by washer 833 and nut 835.

It should be noted that, whereas, in the present embodiment, each of rails 13-1 and 13-2 is attached to brackets 819 on opposite walls, one may instead attach rail 13-1 to a pair of brackets 819 on a first wall and attach rail 13-2 to a pair of brackets 819 on an opposite wall.

Figure 36:
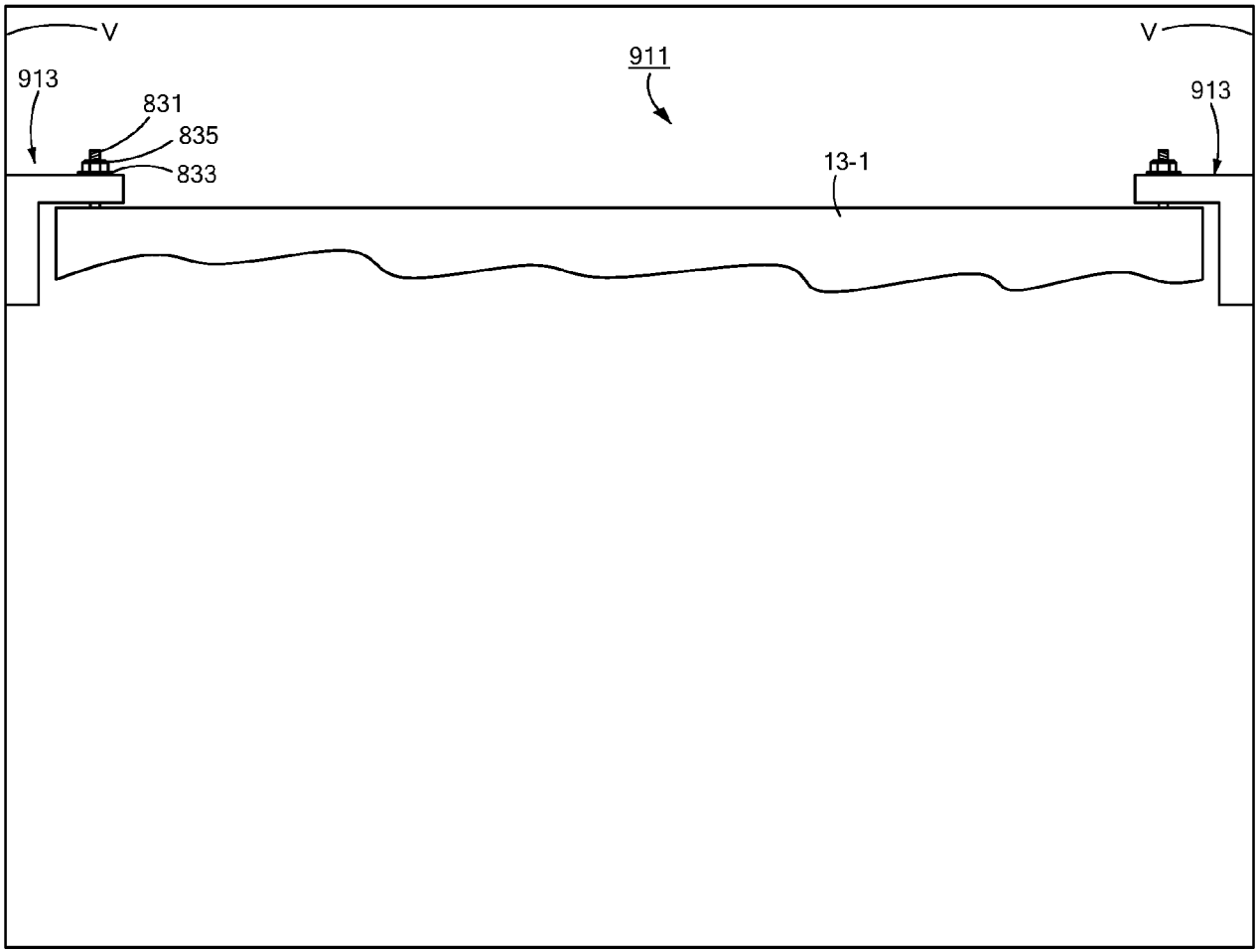
FIG. 36 is a fragmentary side view of a sixth embodiment of a patient positioning system constructed according to the teachings of the present invention, certain components of the patient positioning system not being shown for the sake of clarity.

Referring now to FIG. 36, there is shown a fragmentary side view of a sixth embodiment of a patient positioning system constructed according to the teachings of the present invention, said patient positioning system being represented generally by reference numeral 911. Certain components of system 911, such as, but not limited to, electrical leads, are not being shown for the sake of clarity.

Figure 37A:
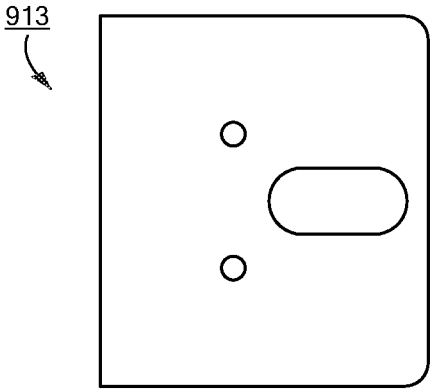
FIGS. 37(*a*) through 37(*c*) are top, end and side views, respectively, of the wall bracket shown in FIG. 36.
Figure 37B:
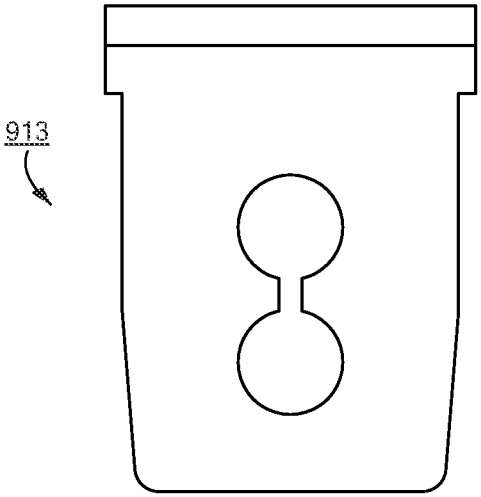
Figure 37C:
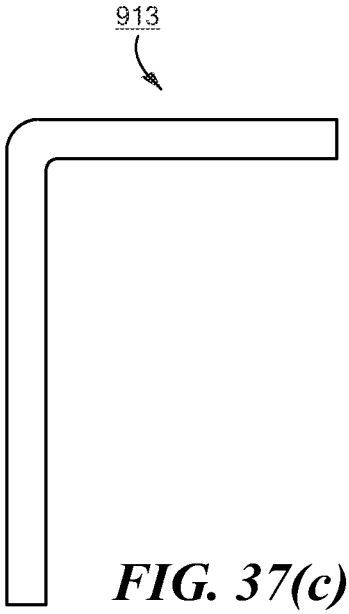

System 911 is similar in many respects to system 811, the principal differences between the two systems being that, whereas system 811 may include four wall studs 813 and four wall stud brackets 819, system 911 may instead include four identical wall brackets 913 (of which only two are shown), brackets 913 (one of which is shown separately in FIGS. 37(*a*) through (*c*)) being secured directly to the vertical walls using lag screws or the like (not shown). Because brackets 913 are secured directly to the vertical wall, the vertical wall is preferably constructed with an internal stud or other internal support necessary to carry the load attached to bracket 913.

The embodiments of the present invention described above are intended to be merely exemplary and those skilled in the art shall be able to make numerous variations and modifications to it without departing from the spirit of the present invention. All such variations and modifications are intended to be within the scope of the present invention.

What is claimed is:

1. A rail for use in a patient positioning system, said rail comprising a substantially hollow structure defined by a top wall, a bottom wall, a left wall connecting the top wall and the bottom wall, and a right wall connecting the top wall and the bottom wall, the substantially hollow structure having a substantially open front, a substantially open rear and a substantially consistent cross section between the front and rear;

a first rib extending from said left wall to said right wall, and a second rib extending from said top wall to said first rib.

2. The rail as claimed in claim 1 wherein the top wall is shaped to include a channel extending longitudinally from said substantially open front to said substantially open rear.

3. The rail as claimed in claim 2 wherein the channel has an inverted "T"-shape in transverse cross-section.

4. The rail as claimed in claim 1 wherein the lower chamber is shaped to include a pair of channels extending longitudinally from said substantially open front to said substantially open rear for receiving a pair of electrode assemblies.

5. The rail as claimed in claim 1 wherein the bottom wall is shaped to include a slit extending from said substantially open front to said substantially open rear and permitting access to said lower chamber through the bottom wall.

6. The rail as claimed in claim 5 wherein the slit is shaped to include a pair of grooves, each groove terminating in a substantially circular shape in transverse cross-section.

7. The rail as claimed in claim 1 wherein said rail further includes at least one of a first flange and a second flange, said first flange extending laterally from said left wall and extending longitudinally from said substantially open front to said substantially open rear, said second flange extending laterally from said right wall and extending longitudinally from said substantially open front to said substantially open rear.

8. The rail as claimed in claim 1 wherein said rail further includes a first flange and a second flange, said first flange extending laterally from said left wall and extending longitudinally from said substantially open front to said substantially open rear, said second flange extending laterally from said right wall and extending longitudinally from said substantially open front to said substantially open rear.

9. The rail as claimed in claim 8 wherein said first flange extends laterally from said left wall for a distance of approximately 0.750 inch and wherein said second flange extends laterally from said right wall for a distance of approximately 0.750 inch.

10. The rail as claimed in claim 1 wherein said rail is made of extruded aluminum.

11. The rail as claimed in claim 1 wherein said rail has a length from said substantially open front to said substantially open rear of approximately 20 feet and has a length from said top wall to said bottom wall of approximately 4.300 inch.

12. The rail of claim 1, further comprising a left flange extending laterally outwardly from the left wall at a point intermediate to said top wall and said bottom wall.

13. The rail of claim 12, further comprising a right flange extending laterally outwardly from the right wall at a point intermediate to said top wall and said bottom wall.

14. The rail of claim 1, further comprising a pair of grooves, each groove terminating in a substantially circular shape in transverse cross-section.

15. The rail of claim 1, wherein the first rib and the second rib jointly divide the interior of the rail into a pair of upper chambers and a lower chamber.

16. The rail of claim 15 wherein the upper chambers have heights that are least in the area proximate the second rib.

17. The rail of claim 1, wherein the left wall has a substantially consistent width between the top wall and the bottom wall, and wherein the right wall has a substantially consistent width between the top wall and the bottom wall.

18. A rail for use in a patient positioning system, the rail comprising:

a top wall and a bottom wall;

a left wall connecting the top wall and the bottom wall;

a right wall connecting the top wall and the bottom wall;

a first rib extending from the left wall to the right wall and defining a lower chamber, wherein the bottom wall defines a slit that provides access to the lower chamber;

a second rib extending from the top wall to the first rib and defining a pair of upper chambers, the upper chambers having heights that are least in the area proximate the second rib;

a left flange extending laterally outwardly from the left wall at a point intermediate to said top wall and said bottom wall; and a right flange extending laterally outwardly from the right wall at a point intermediate to said top wall and said bottom wall.

19. A rail for use in a patient positioning system, said rail comprising a substantially hollow structure defined by a top wall, a bottom wall, a left wall connecting the top wall and the bottom wall, and a right wall connecting the top wall and the bottom wall, the substantially hollow structure having a substantially open front, and a substantially open rear;

a first rib extending from said left wall to said right wall, and a second rib extending from said top wall to said first rib and defining a pair of upper chambers, the upper chambers having heights that are least in the area proximate the second rib.

* * * * *